US007685671B2

(12) United States Patent
Jansen

(10) Patent No.: US 7,685,671 B2
(45) Date of Patent: Mar. 30, 2010

(54) BARE FLOOR CLEANER

(75) Inventor: John L. Jansen, Comstock Park, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 938 days.

(21) Appl. No.: 10/595,113

(22) PCT Filed: Aug. 20, 2004

(86) PCT No.: PCT/US2004/026952

§ 371 (c)(1),
(2), (4) Date: Feb. 21, 2006

(87) PCT Pub. No.: WO2005/018402

PCT Pub. Date: Mar. 3, 2005

(65) Prior Publication Data

US 2008/0189901 A1 Aug. 14, 2008

Related U.S. Application Data

(60) Provisional application No. 60/481,277, filed on Aug. 22, 2003.

(51) Int. Cl.
*A47L 7/00* (2006.01)
*A47L 9/02* (2006.01)

(52) U.S. Cl. ..... 15/328; 15/320

(58) Field of Classification Search ..... 15/320, 15/322, 328, 331, 334, 387, 339
See application file for complete search history.

(56) References Cited

U.S. PATENT DOCUMENTS

| | | | | |
|---|---|---|---|---|
| 2,622,254 | A | 12/1952 | Mendelson | |
| 4,557,013 | A | 12/1985 | Belmont | |
| 4,951,346 | A | 8/1990 | Salmon | |
| 5,483,726 | A | 1/1996 | Blase et al. | |
| 5,983,442 | A * | 11/1999 | Louis et al. | 15/320 |
| 6,101,668 | A | 8/2000 | Grey | |
| 6,629,332 | B2 | 10/2003 | Morgan | |
| 6,640,386 | B2 | 11/2003 | Morgan | |
| 6,647,578 | B2 | 11/2003 | Morgan | |
| 6,832,409 | B2 | 12/2004 | Morgan | |
| 6,842,942 | B2 | 1/2005 | Morgan et al. | |

FOREIGN PATENT DOCUMENTS

| | | | |
|---|---|---|---|
| DE | 29714910 | U | 11/1997 |
| GB | 2322065 | A | 8/1998 |

* cited by examiner

*Primary Examiner*—David B Thomas
(74) *Attorney, Agent, or Firm*—McGarry Bair PC

(57) ABSTRACT

A bare floor cleaner for wet and dry bare floor surfaces comprises a base with wet and dry suction nozzles and a handle pivotally connected to the base. A diverter mounted in the working air conduit between each of the dry suction nozzle and the wet suction nozzle to a recovery tank is movable by movement of the handle between a dry suction position and a wet suction position for selectively at least partially blocking working air flow from the wet suction nozzle and the dry suction nozzle, respectively, to the recovery tank.

20 Claims, 29 Drawing Sheets

BARE FLOOR CLEANER

CROSS-REFERENCE TO RELATED APPLICATIONS

This application is a national phase patent application of PCT/US2004/026952, filed Aug. 20, 2004, which claims the benefit of U.S. Provisional Application No. 60/481,277, filed Aug. 22, 2003, which is incorporated herein by reference.

BACKGROUND OF THE INVENTION

1. Field of the Invention

The invention relates to wet and dry cleaning of bare floor surfaces. In one aspect, the invention relates to a bare floor cleaner that performs both wet and dry pickup. In another aspect, the invention relates to a bare floor cleaner that selectively performs wet and dry floor cleaning functions by convenient movement of a manipulating handle. In yet another aspect, the invention relates to a bare floor cleaner having a diverter for selectively blocking one of a wet nozzle opening and dry nozzle opening, wherein the diverter is actuated by movement of a handle assembly.

2. Description of the Related Art

The common procedure of cleaning a bare floor surface, such as tile, linoleum, and hardwood floors, involves several steps. First, dry or loose dust, dirt, and debris are removed, followed by applying liquid cleaning solution the surface either directly or by means of an agitator. Motion of the agitator with respect to the bare surface acts to loosen the remaining dirt. The agitator can be a stationary brush or cloth that is moved by the user or a motor driven brush that is moved with respect to a base support by a motor. If the agitator is absorbent, it will remove the dirt and collect a portion of the soiled cleaning solution from the floor; otherwise, the dirt and soiled cleaning solution must be removed by another means. Finally, the remaining soiled cleaning solution on the surface is commonly left to air dry, and the duration of time required for the bare surface to completely dry depends on the amount of residual solution on the floor. During this period, it is best to avoid foot traffic in the area because dirt and debris easily adheres to a wet surface.

Washing a bare floor is commonly accomplished with multiple cleaning tools. For example, the first step of removing dry particles most often employs a conventional broom and dustpan. However, when sweeping dirt from a pile into the dustpan, it is difficult to transfer the entire pile, and, as a result, a portion of the pile tends to remain on the floor. Additionally, a user typically bends over to hold the dustpan in place while collecting the dirt pile. Such motion can be inconvenient, difficult, and even painful for some users. Dust cloths can also be used, but large dirt particles do not sufficiently adhere thereto. Another option is vacuuming the dry dirt, but most homes are equipped with vacuum cleaners that are designed for use on carpets and can damage bare surfaces.

Tools for applying and/or agitating cleaning solution have similar deficiencies. The most common cleaning implement for these steps is the traditional sponge or rag mop. Mops are capable of loosening dirt from the floor and have excellent absorbency; however, once the mop requires more cleaning solution, it is placed in a bucket to soak up warm cleaning solution and returned to the floor. Each time, the mop is usually placed in the same bucket, and after several repetitions, the cleaning solution becomes dirty and cold. As a result, spent cleaning solution is used to remove dirt from the bare surface. Furthermore, movement of the mop requires physical exertion, and the mop head wears with use and must be replaced periodically. Textured cloths can be used as an agitator, but they also require physical exertion and regular replacement. Additionally, cloths are not as absorbent as mops and, therefore, can leave more soiled cleaning solution on the floor.

Some household cleaning devices have been developed to eliminate the need for multiple cleaning implements for washing a bare floor and alleviate some of the problems described above that are associated with the individual tools. Such household devices are usually adapted for vacuuming or sweeping dry dirt and dust prior to application of cleaning solution, applying and agitating the cleaning solution, and, subsequently, vacuuming the soiled cleaning solution, thereby leaving only a small amount of cleaning solution on the bare surface. Common agitators are rotating brushes, rotating mop cloths, and stationary or vibrating sponge mops. A good portion of the multifunctional cleaning devices utilizes an accessory that is attached to the machine to convert between dry and wet cleaning modes. Others are capable of performing all functions without accessories but have complex designs and features that can be difficult and confusing to operate.

Examples of multi-functional bare floor cleaners are disclosed in U.S. Pat. Nos. 2,622,254 and 6,101,668 and in U.S. Patent Application Publication Nos. 2003/0051301, 2003/0051306, 2003/0051308, 2003/0051309, and 2003/00513010. The '254 patent discloses an apparatus for cleaning bare and carpeted floors and comprises several independently adjustable cleaning implements, such as a squeegee attached to a suction pipe, a scrubbing roll, and a sweeping roll. The apparatus can accomplish wet pickup through the suction pipe, wet scrubbing by means of the scrubbing roll, and dry pickup with a dust collecting nozzle disposed adjacent the sweeping roll.

The above listed family of patent application publications discloses a bare floor cleaner having independently adjustable nozzle and brush assemblies. The nozzle assembly comprises a single nozzle opening that is surrounded by an overmolded squeegee and through which both wet and dry debris can enter. The cleaner operates in a wet pickup mode with the nozzle assembly in contact with the surface to be cleaned. The nozzle assembly is raised to a position above the surface to be cleaned for operation in a dry pickup mode.

The '668 patent is an example of a cleaner that can accomplish all the steps required to clean a bare floor with the assistance of an attachment. The cleaner has a cleaning head equipped with a nozzle having squeegees on the front and rear sides thereof and a vertically adjustable scrubbing pad through which cleaning solution can be dispensed. When a cover is attached to the bottom of the cleaning head, the entire cleaning head, including the squeegees, nozzle, and pad, are raised from the floor to permit dry pickup.

SUMMARY OF THE INVENTION

A wet/dry bare floor cleaner according to the invention comprises a base; a handle pivotally connected to the base; a recovery system comprising a wet suction nozzle, a dry suction nozzle, a recovery tank for receiving wet and dry debris, a working air conduit extending from each of the dry suction nozzle and the wet suction nozzle to the recovery tank, a motor/fan assembly mounted to one of the handle and the base and adapted to create a working air flow in the working air conduit from at least one of the dry suction nozzle and the wet nozzle and to the recovery tank, and a diverter mounted in the working air conduit and movable between a dry suction position and a wet suction position for selectively at least partially blocking working air flow from the wet suction nozzle and the dry suction nozzle, respectively, to the recovery tank; and the improvement comprising an actuator mounted to the handle and connected to the diverter to move the diverter between the dry suction position and the wet suction position.

In one embodiment, the actuator includes a connector between the handle and the diverter so that the diverter moves between the dry suction position and the wet suction position as the handle rotates between a dry suction position and a wet suction position.

In another embodiment, when the handle is in the dry suction position, the handle is pivoted towards the wet suction nozzle. When the handle is in the wet suction position, the handle is pivoted towards the dry suction nozzle. The base has opposite end portions, and the dry suction nozzle and the wet suction nozzle are respectively positioned at the opposite end portions of the base.

In yet another embodiment, when the handle is in the wet suction position, it overlies one end of the base, and when it is in the dry suction position, it overlies another end of the base.

In another embodiment, the diverter comprises a cylindrical barrel with an inlet at one side wall portion and an outlet at another side wall portion. The diverter includes a conduit forming the outlet of the cylindrical barrel, and the handle is mounted to the conduit. The conduit forms the connector between the handle and the diverter. The cylindrical barrel is pivotally mounted in the base.

In yet another embodiment, the wet/dry bare floor cleaner further comprises an agitator mounted to the base for vertical movement between a lowered position in contact with the surface to be cleaned and a raised position above the surface to be cleaned for selectively agitating the surface to be cleaned. The wet/dry bare floor cleaner further comprises a connector between the agitator and the diverter for moving the agitator between the lowered position and the raised position as the diverter moves between the wet suction position and the dry suction position.

In one embodiment, the agitator is a brush that is movably mounted to the base for scrubbing the surface to be cleaned. The brush can mounted to the base for rotation about a vertical axis and the wet/dry bare floor cleaner can comprise a motor for driving rotational movement of the brush with respect to the base.

In another embodiment, the agitator is a brush comprising a first set of bristles and a second set of bristles wherein the first bristles are longer than the second bristles and are softer than the second bristles. The first and second sets of bristles are in alternating juxtaposed rows in the brush.

In yet another embodiment, the wet/dry bare floor cleaner further comprises a fluid delivery system including a fluid tank; a fluid distributor for dispensing fluid onto a surface to be cleaned; and a fluid distribution conduit between the fluid tank and the fluid distributor.

Further according to the invention, a wet/dry bare floor cleaner according to the invention comprises a base; a handle pivotally connected to the base; a recovery system comprising a wet suction nozzle, a dry suction nozzle, a recovery tank for receiving wet and dry debris, a working air conduit extending from each of the dry suction nozzle and the wet suction nozzle to the recovery tank, a motor/fan assembly mounted to one of the handle and the base and adapted to create a working air flow in the working air conduit from at least one of the dry suction nozzle and to the recovery tank, and a diverter mounted in the working air conduit and movable between a dry suction position and a wet suction position for selectively at least partially blocking working air flow from the wet suction nozzle and the dry suction nozzle, respectively, to the recovery tank; and the improvement comprising an agitator mounted to the base for vertical movement between a lowered position in contact with the surface to be cleaned and a raised position above the surface to be cleaned for selectively agitating the surface to be cleaned.

In one embodiment, the wet/dry bare floor cleaner further comprises a connector between the agitator and the diverter for moving the agitator between the lowered and raised positions.

In another embodiment, the agitator is a brush that is movably mounted to the base for agitating the surface to be cleaned.

In yet another embodiment, the agitator is a brush comprising a first set of bristles and a second set of bristles wherein the first bristles are longer than the second bristles and are softer than the second bristles. The first and second sets of bristles can be in alternating juxtaposed rows in the brush.

Still further according to the invention, a wet/dry bare floor cleaner according to the invention comprises a base; a handle pivotally connected to the base; a recovery system comprising a wet suction nozzle, a dry suction nozzle, a recovery tank for receiving wet and dry debris, a working air conduit extending from each of the dry suction nozzle and the wet suction nozzle to the recovery tank, a diverter mounted in the working air conduit and movable between a dry suction position and a wet suction position for selectively at least partially blocking working air flow from the wet suction nozzle and the dry suction nozzle, respectively, to the recovery tank, and a motor/fan assembly mounted to one of the handle and the base and adapted to create a working air flow in the working air conduit from at least one of the dry suction nozzle and the wet nozzle and to the recovery tank; and the improvement comprising a shut-off valve mounted in the recovery tank and adapted to prevent fluid communication between the motor/fan assembly and the recovery tank when the amount of liquid in the recovery tank reaches a first predetermined amount when the handle is in a first position forward of a vertical position and a second predetermined amount different than the first predetermined amount when the handle is in a second position rearward of the vertical position.

In one embodiment, the recovery tank comprises an outlet, and the shut-off valve comprises a float adapted to close the outlet when the amount of liquid in the recovery tank reaches the first predetermined amount when the handle is in the first position and the second predetermined amount when the handle is in the second position. The float can be offset from a longitudinal axis of the recovery tank so that the float is below the longitudinal axis when the handle is in the first position and above the longitudinal axis when the handle is in the second position.

In another embodiment the wet/dry bare floor cleaner further comprises an actuator connected to the handle and the diverter and adapted to move the diverter between the dry suction position and the wet suction position as the handle rotates between the first position and the second position, respectively.

In yet another embodiment, the first amount of liquid is less than the second amount of liquid.

In still another embodiment, the wet/dry bare floor cleaner further comprises a fluid delivery system comprising a fluid tank; a fluid distributor for dispensing fluid onto a surface to be cleaned; and a fluid distribution conduit between the fluid tank and the fluid distributor.

Still further according to the invention, a wet/dry bare floor cleaner according to the invention comprises a base; a handle pivotally connected to the base for movement between a dry suction position and a wet suction position; a recovery system comprising a wet suction nozzle, a dry suction nozzle, a recovery tank for receiving wet and dry debris, a working air conduit extending from each of the dry suction nozzle and the wet suction nozzle to the recovery tank, a diverter mounted in the working air conduit and movable between a dry suction position and a wet suction position for selectively at least partially blocking working air flow from the wet suction nozzle and the dry suction nozzle, respectively, to the recovery tank; and a motor/fan assembly mounted to one of the handle and the base and adapted to create a working air flow in the working air conduit from at least one of the dry suction nozzle and the wet nozzle and to the recovery tank; and the improvement comprising a bi-directional grip on the handle having a first portion adapted to be conveniently gripped by a hand of the user when the handle is in the dry suction position and a second portion which is adapted to be conveniently gripped by the hand of the user in substantially the same relative position when the handle is in the wet suction position.

In one embodiment, the first portion extends away from the handle in one direction, and the second portion extends away from the handle in an opposite direction. The first portion and the second portion are bilaterally symmetric.

In another embodiment, the wet/dry bare floor cleaner further comprises a fluid delivery system comprising a fluid tank; a fluid distributor for dispensing fluid onto a surface to be cleaned; and a fluid distribution conduit between the fluid tank and the fluid distributor.

In one embodiment, the wet/dry bare floor cleaner further comprises a trigger mounted to one of the first and second portions and connected to the fluid distribution system to distribute fluid to the surface to be cleaned.

In yet another embodiment, the base has opposite end portions, and the dry suction nozzle and the wet suction nozzle are respectively positioned at opposite end portions of the base. When the handle is in the wet suction position, it overlies one end of the base, and when it is in the dry suction position, it overlies the opposite end of the base.

DESCRIPTION OF THE PREFERRED EMBODIMENTS

Figure 1A:
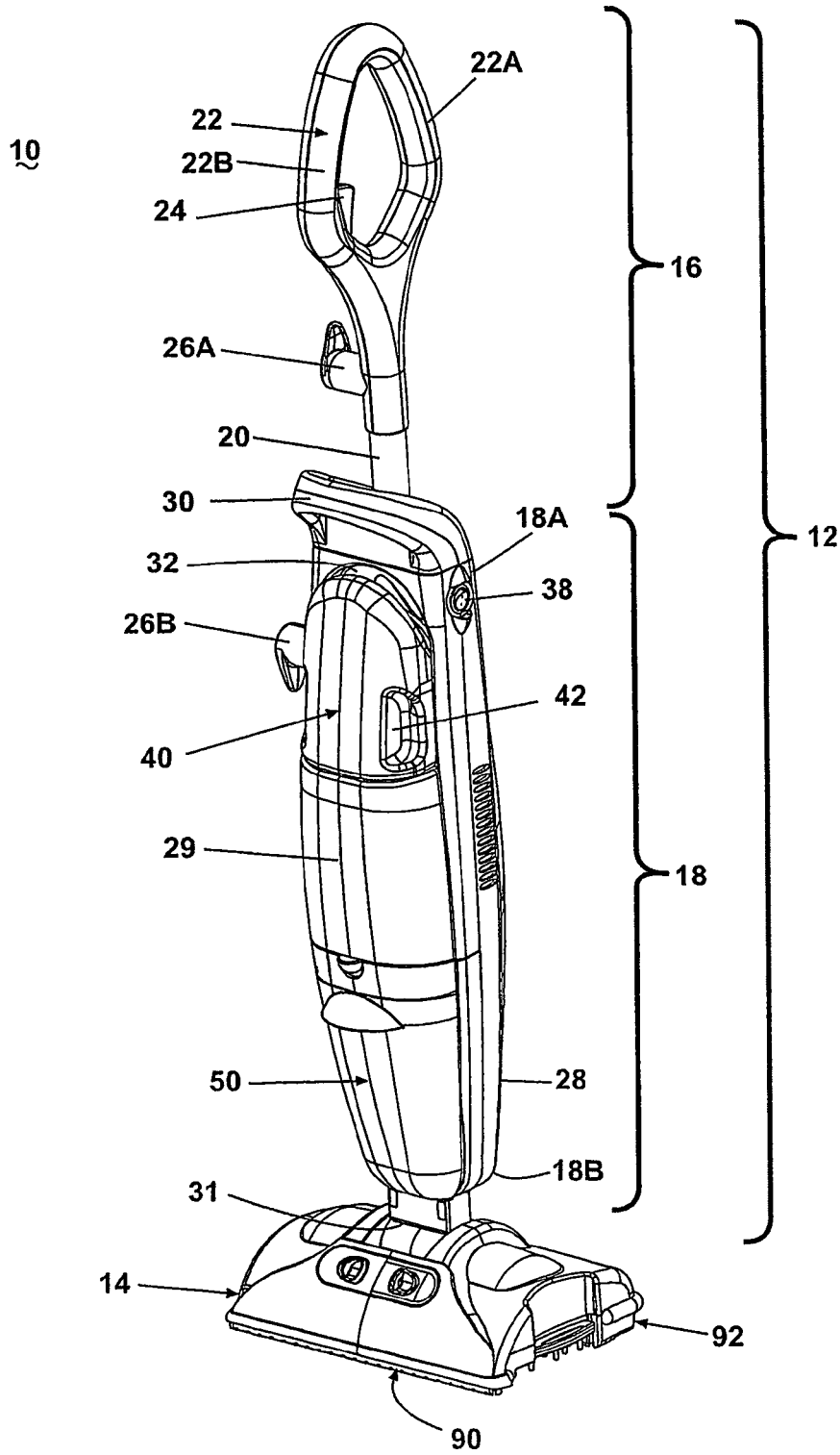
FIG. 1A is a front perspective view of a bare floor cleaner according to the invention and comprising a foot assembly and a handle assembly.
Figure 1B:
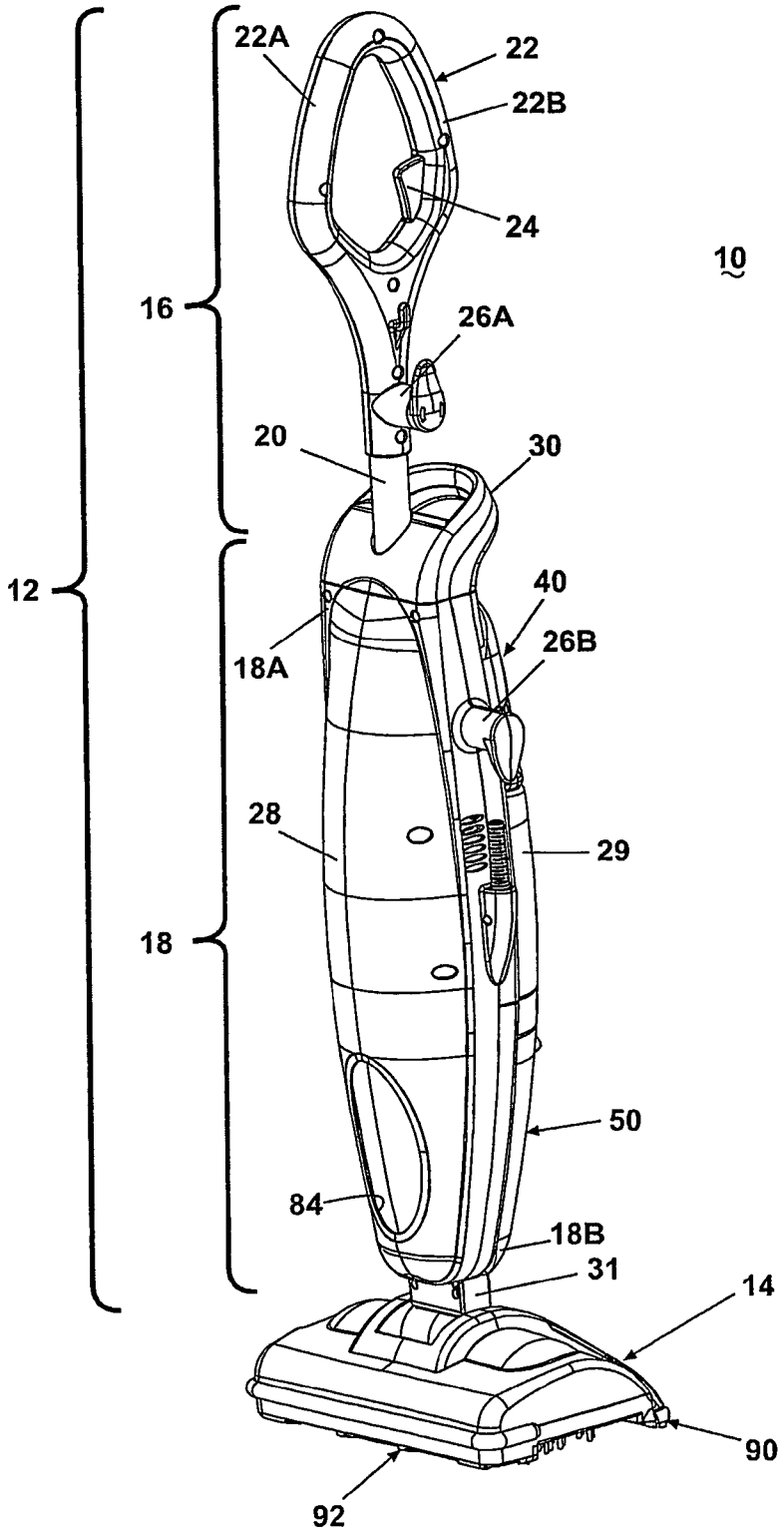
FIG. 1B is a rear perspective view of the bare floor cleaner shown in FIG. 1A.
Figure 2A:
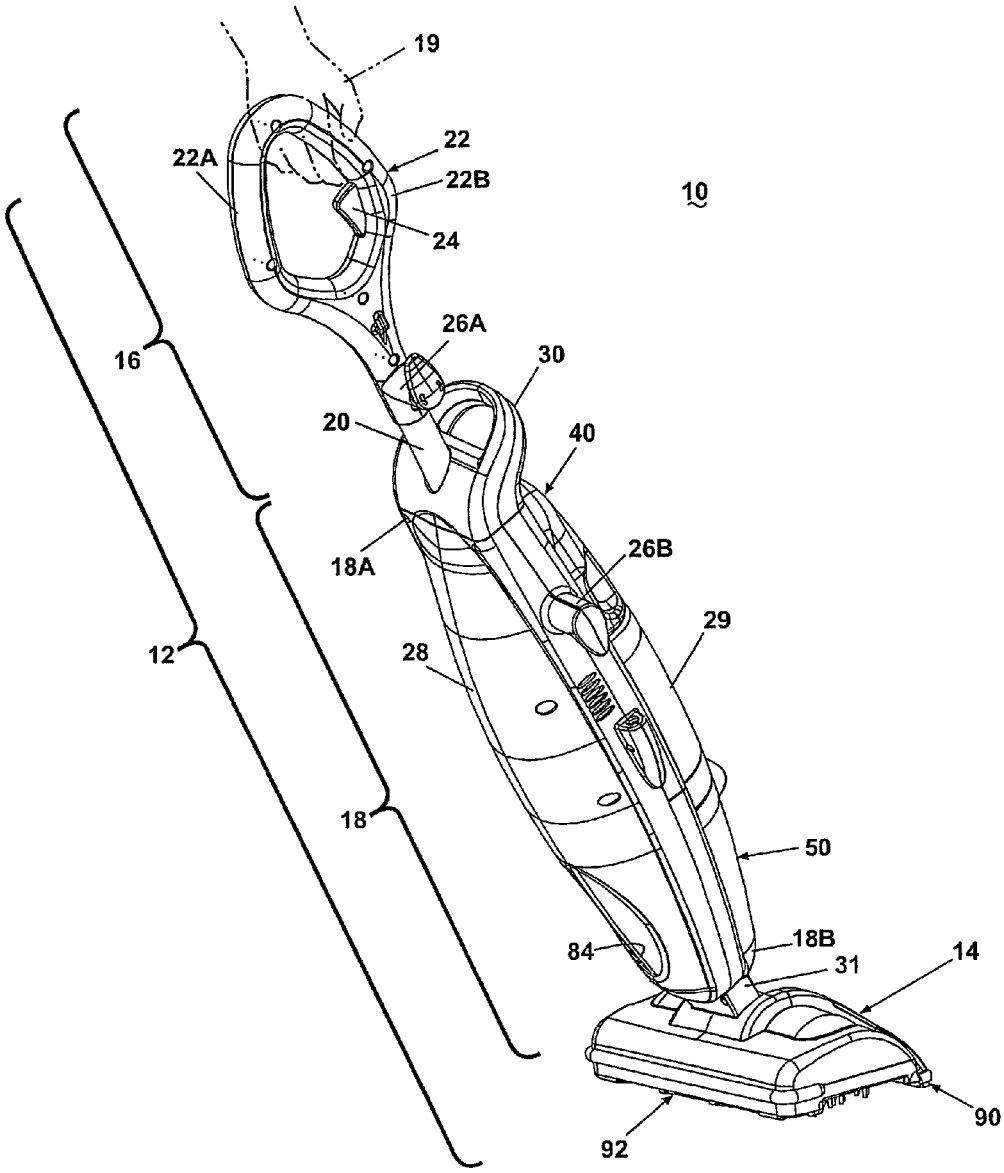
FIG. 2A is a rear perspective view of the bare floor cleaner shown in FIG. 1A and pivoted relative to the foot assembly to a first position.
Figure 2B:
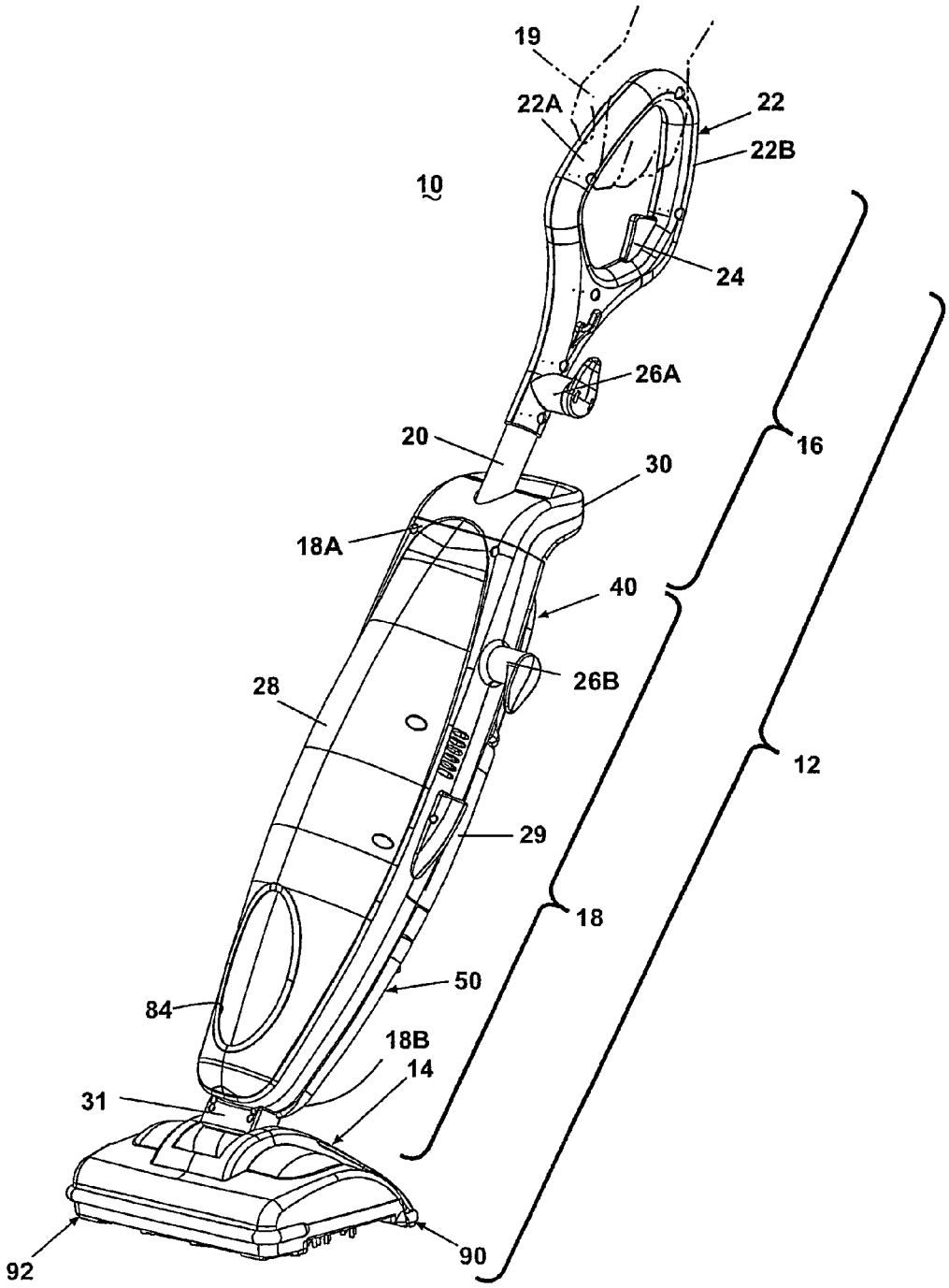
FIG. 2B is a rear perspective view of the bare floor cleaner shown in FIG. 1A and pivoted relative to the foot assembly to a second position.

Referring to the drawings and to FIGS. 1A, 1B, 2A, and 2B in particular, a wet/dry bare floor cleaner 10 according to the invention comprises a handle assembly 12 pivotally mounted to a base or foot assembly 14. The handle assembly 12 can pivot from an upright, vertical position, as shown in FIGS. 1A and 1B, wherein the handle is substantially vertical relative to the surface to be cleaned, to either direction relative to the foot assembly 14. In particular, the handle assembly 12 can pivot to a first position forward of the upright position, as shown in FIG. 2A, or to a second position rearward of the vertical position, as illustrated in FIG. 2B.

Figure 3:
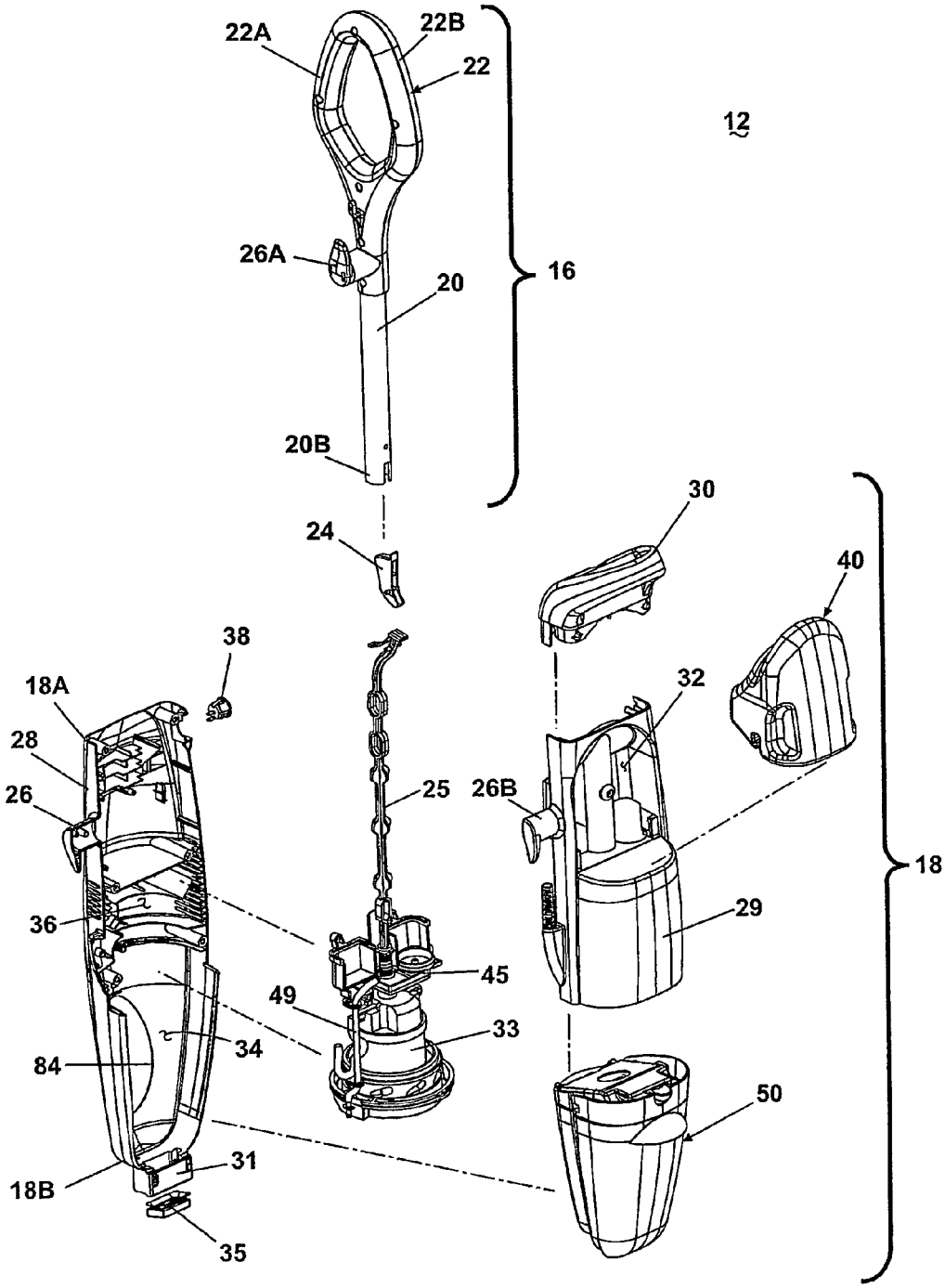
FIG. 3 is an exploded view of the handle assembly of the bare floor cleaner shown in FIG. 1.
Figure 4:
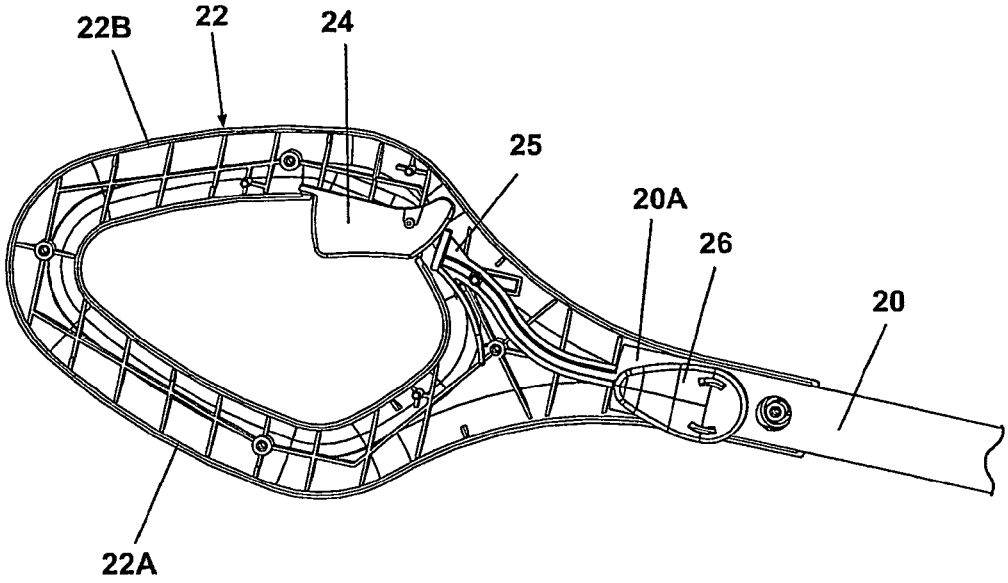
FIG. 4 is a side view of a grip of the handle assembly shown in FIG. 3, wherein one half of the grip has been removed to show the interior of the grip.

Referring additionally to FIGS. 3 and 4, the handle assembly 12 comprises an upper handle 16 and a lower handle 18, and the upper handle 16 comprises a hollow tube 20 with an upper end 20A and a lower end 20B. A bi-directional grip 22 is fixedly attached to the upper end 20A of the tube 20; however, it is within the scope of the invention to utilize other grips commonly found on upright vacuum cleaners and extraction machines. The grip 22 provides a user interface to manipulate the wet/dry bare floor cleaner 10 when the handle assembly 12 is in either the first position or the second position. In particular, the grip 22 has a first portion 22A and a second portion 22B that extend away from the tube 20 in opposite directions, and, preferably, the first and the second portions 22A, 22B are bilaterally symmetrical. When the handle assembly 12 is in the first position, the user grasps the first portion 22A of the grip 22 with a hand 19, as shown in FIG. 2A, to move the bare floor cleaner 10 across the surface to be cleaned. Conversely, when the handle assembly 12 is in the second position, the user grasps the second portion 22B of the grip 22 with the hand 19, as depicted in FIG. 2B. Because the grip 22 is bilaterally symmetrical, the first and second portions 22A, 22B can be grasped by the user in substantially the same relative position when the handle assembly 12 is in the first and second positions, respectively. As a result, the feel of the grip 22 in the hand 19 is generally the same regardless of the orientation of the handle assembly 12. Additionally, the grip 22 preferably comprises two halves that mate to form a recess therebetween. As best viewed in FIG. 4, wherein one of the halves of the grip 22 is removed for illustrative purposes, a trigger 24 is mounted to the second portion 22B of the grip 22 with a portion of the trigger 24 projecting inward toward the second portion 22B of the grip 22. The rest of the trigger 24 resides in the recess formed by the grip 22 and communicates with a push rod 25 that runs through the hollow interior of the tube 20. A cord wrap 26A attached to, or integrally molded with, the grip 22 forms a peg-like structure oriented generally orthogonal relative to the tube 20 for storing a power cord (not shown). The lower end 20B of the tube 20 is fixedly attached to the lower handle 18.

The lower handle 18 comprises a generally elongated rear enclosure 28, which includes a lower viewing aperture 84 and provides structural support for components contained therein. A front enclosure 29 mates with the rear enclosure 28 to form a central cavity 36 therebetween and a first recess 32 above the front enclosure 29 and a second recess 34 below the front enclosure 29. The lower handle 18 comprises an upper end 18A and a lower end 18B, and a carry handle 30 at the upper end 18A. The carry handle 30 is disposed at an angle relative to the tube 20 and facilitates manually lifting the bare floor cleaner 10 from the surface to be cleaned. A second cord wrap 26B is located on an upper surface of the rear enclosure 28 near the carry handle 30. The power cord can be wrapped around the cord wraps 26A, 26B on the upper handle 16 and the lower handle 18 to conveniently store the power cord when the cleaner 10 is not in use. The lower end 18B of the lower handle 18 comprises a generally rectangular conduit 31 defining a working air inlet that fluidly communicates the handle assembly 12 with the foot assembly 14.

A motor/fan assembly 33 is mounted in the cavity 36 defined by the rear enclosure 28 and the front enclosure 29 and located between the first recess 32 and the second recess 34. The motor/fan assembly 33 creates airflow, which moves debris and liquid material from the surface being cleaned and through the cleaner 10. The power cord is connected to the motor/fan assembly 33 through an electrical on/off switch 38 located on either the rear enclosure 28, the front enclosure 29, or therebetween.

Figure 5:
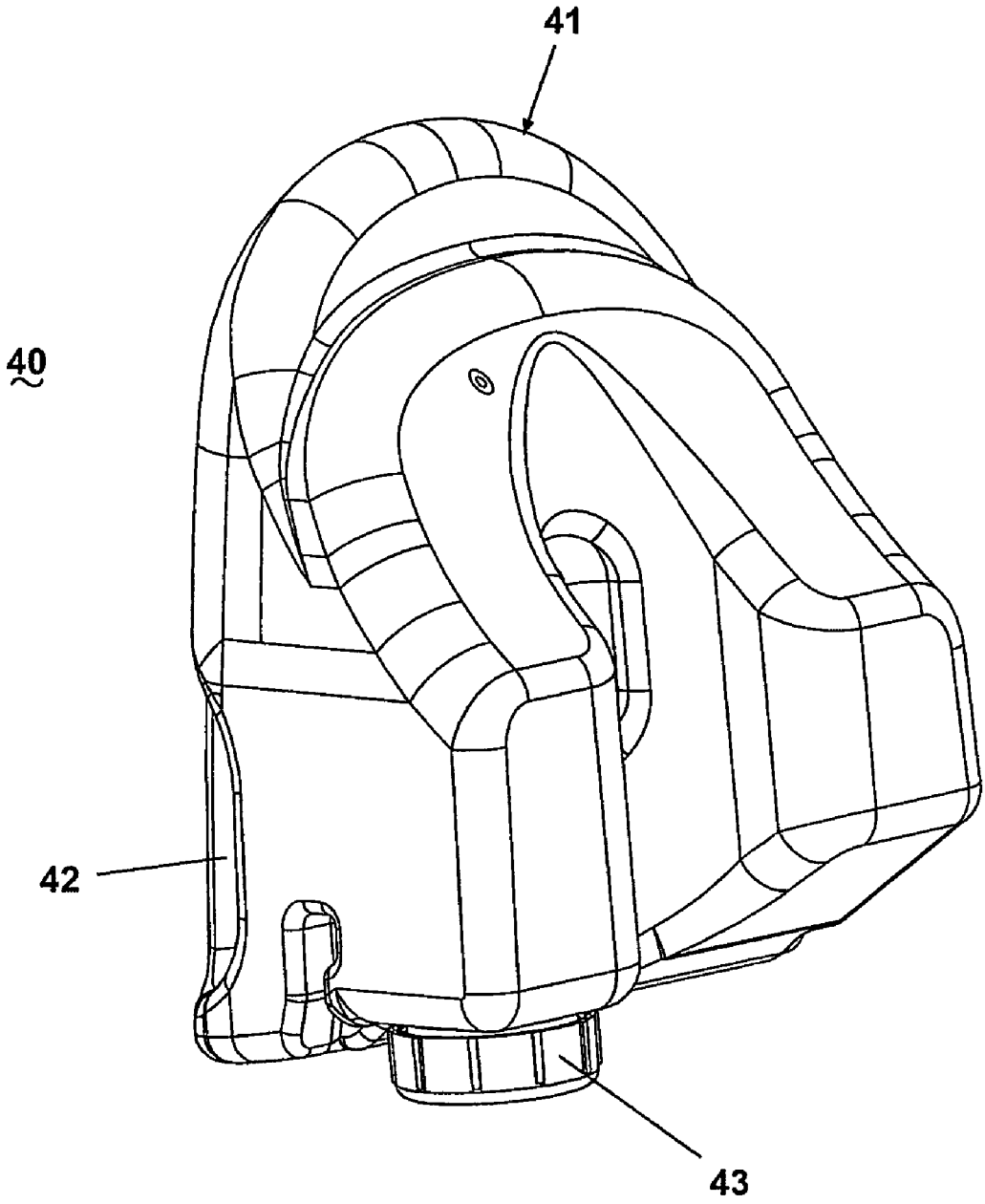
FIG. 5 is a rear perspective view of a solution tank assembly from the handle assembly shown in FIG. 3.
Figure 6:
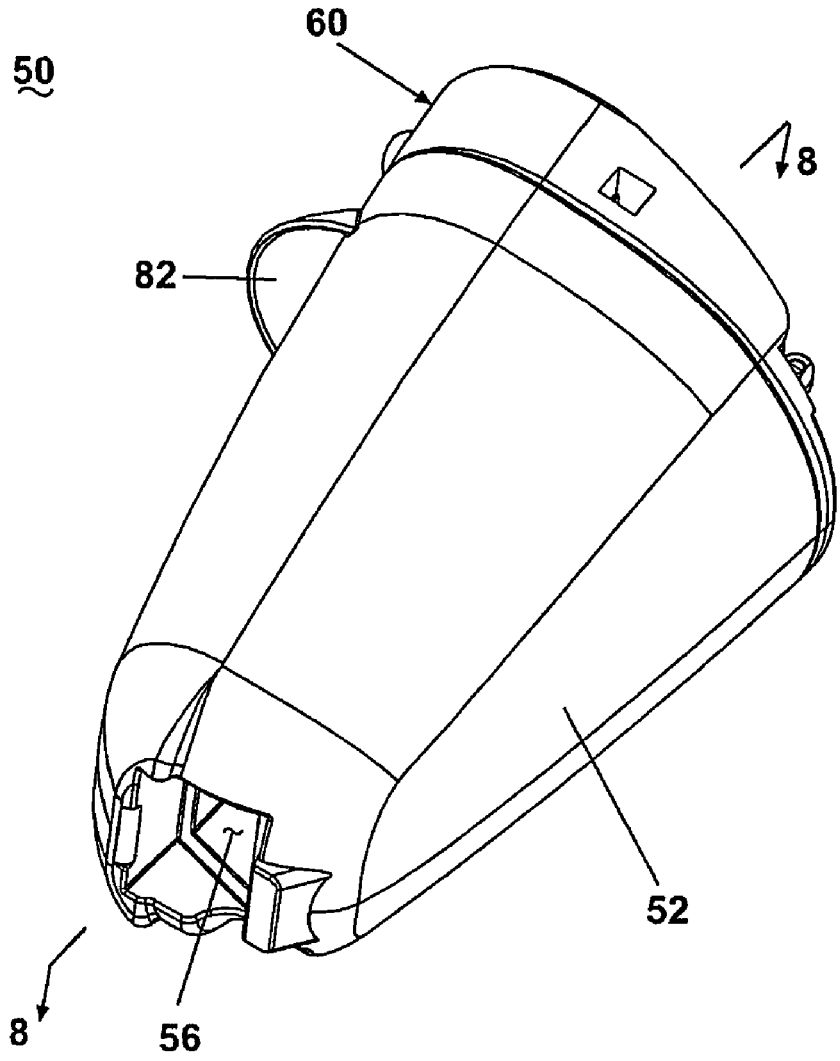
FIG. 6 is a bottom perspective view of a recovery tank assembly from the handle assembly shown in FIG. 3.
Figure 7:
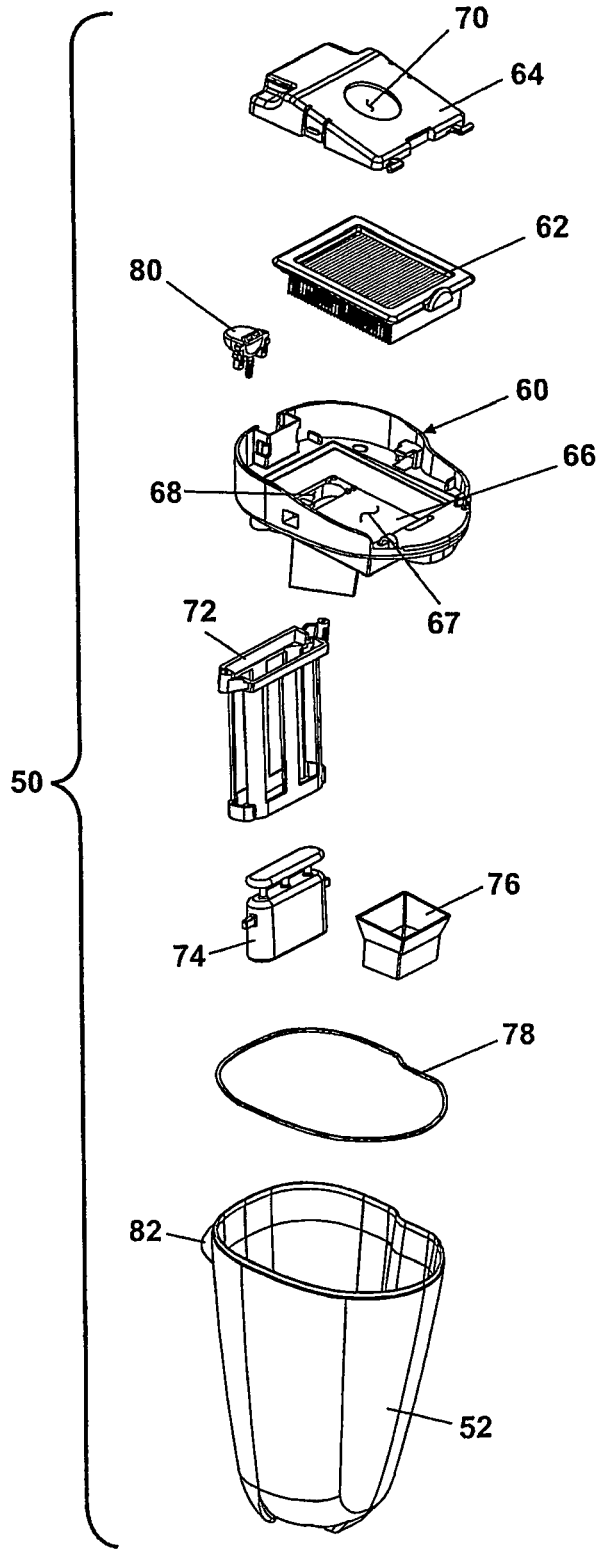
FIG. 7 is an exploded view of the recovery tank assembly shown in FIG. 6.

Referring to FIGS. 1A, 3 and 5, a solution tank assembly 40 is removably mounted to the lower handle 18 such that it partially rests on the front enclosure 29 and is partially received by the first recess 32. The solution tank assembly 40 comprises a tank 41 to hold a predetermined amount of liquid, such as water, cleaning detergent, or a mixture thereof. A tank grip 42 sized to receive at least a portion of a user's hand is integrally molded in both sides of the tank 41. The solution tank assembly 40 further comprises a tank valve assembly 43 similar to that found in U.S. Pat. No. 6,467,122, which is incorporated herein by reference in its entirety. The tank valve 43 mates with a receiver valve assembly 45 mounted to the rear enclosure 28 and located above the motor/fan assembly 33. A flexible conduit 49 is fluidly connected to an output of the receiver valve assembly 45 and is routed through the lower handle 18 to the foot assembly 14. The receiver valve assembly 45 is actuated and opened when the user depresses the trigger 24 to thereby force the push rod 25 to travel a predetermined distance and open the receiver valve assembly 45. Once the receiver valve assembly 45 is opened, solution moves under force of gravity from the solution tank assembly 40, through the receiver valve assembly 45, and through the conduit 49 to the foot assembly 14.

Referring to FIGS. 1A, 1B, 3, and 6-8B, a recovery tank assembly 50, preferably constructed, at least partially, of a translucent material, is removably received in the second cavity 34. Because the recovery tank 52 is at least partially translucent, a user can view liquid, dirt, and debris in the recovery tank assembly 50 through the viewing aperture 84 in the rear enclosure 28, as best seen in FIG. 1B. This feature is especially useful when the handle assembly 12 is oriented in the second position.

The recovery tank assembly 50 comprises a recovery tank 52 with an integral hollow standpipe 54 formed therein. The standpipe 54 is oriented such that it is generally coincident with a longitudinal axis of the recovery tank 52. The standpipe 54 forms a flow path between an inlet 56 formed at a lower end of the recovery tank 52 and an outlet 58 on the interior of the recovery tank 52. When the recovery tank assembly 50 is mounted to the handle assembly 12, the inlet 56 is aligned with the rectangular conduit 31 to establish fluid communication between the foot assembly 14 and the recovery tank 52. A flared diffuser 76 that aids in separation of liquid and debris from air is mounted to an upper portion of the standpipe 54. A lid 60 sized for receipt on the recovery tank 52 supports a commonly known pleated filter 62 in a filter chamber 67 formed between a bottom wall 66 of the lid 60 and a filter chamber top 64 mounted to the lid 60. Preferably, the pleated filter 62 is made of a material that remains porous when wet. The lid 60 further comprises an inlet aperture 68 formed through the bottom wall 66, and the filter chamber top 64 includes an outlet aperture 70. A gasket 78 positioned between mating surfaces of the lid 60 and the recovery tank 52 creates a seal therebetween for prevention of leaks. Further, the recovery tank assembly 50 is designed so that no lift is produced at either of the wet and dry suction nozzle openings 145, 152 if the pleated filter 62 is not in the filter chamber 67. In the absence of the pleated filter 62, an intentional large leak prevents debris from being drawn into the recovery tank 52 and the motor/fan assembly 33 to thereby protect the motor/fan assembly 33 from premature failure.

A shut-off valve comprising a float cage 72 that encloses a movable float 74 is fixedly attached to the bottom wall 66 of the lid 60 and is in fluid communication with the inlet aperture 68. The float 74 is buoyant and oriented so that the top of the float 74 can selectively seal the inlet aperture 68 when the fluid in the recovery tank reaches a predetermined level. The float cage 72 resides in the recovery tank 52 in a position offset from the standpipe 54. The float cage 72 is preferably located forward of the standpipe 54 and on the same side of the bare floor cleaner 10 as the trigger 25. Consequently, an amount of liquid 51 in the recovery tank 52 required for the float 74 to seal the inlet aperture 68 is less when the handle assembly 12 is pivoted to the first position with the float cage 72 below the standpipe 54, as shown in FIG. 8A, than when the handle assembly 12 is pivoted to the second position with the float cage 72 above the standpipe 54, as illustrated in FIG. 8B. The first and second positions of the handle assembly 12 respectively correspond to dry and wet operation modes, as will be described in further detail hereinafter.

A latch 80, which is positioned on an upper forward portion of the lid 60, releasbly engages with the front enclosure 29 for removably securing the recovery tank assembly 50 to the handle assembly 12. A hand grip 82 integrally formed in the recovery tank 52 and located below the latch 80 facilitates handling of the recovery tank assembly 50 by the user when mounting the recovery tank assembly 50 to and removing it from the handle assembly 12.

Figure 8:
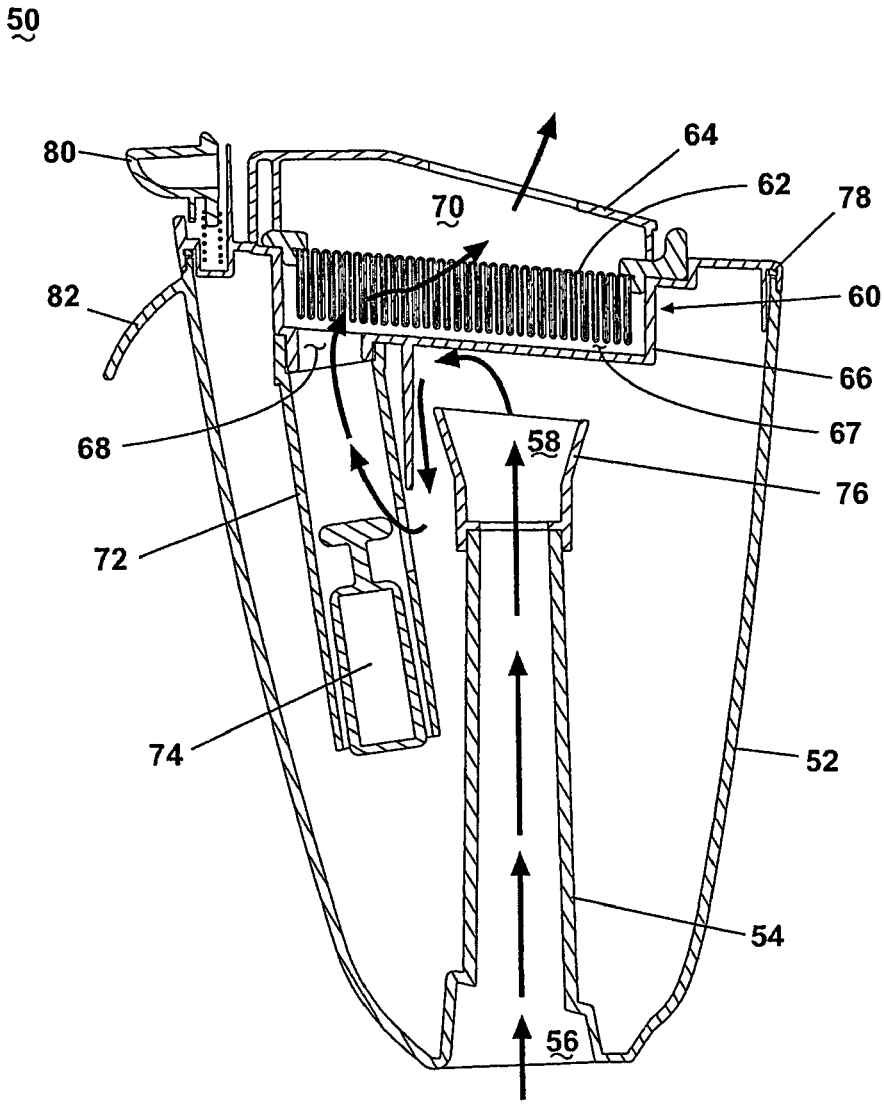
FIG. 8 is a sectional view of the recovery tank assembly shown in FIG. 6.
Figure 8A:
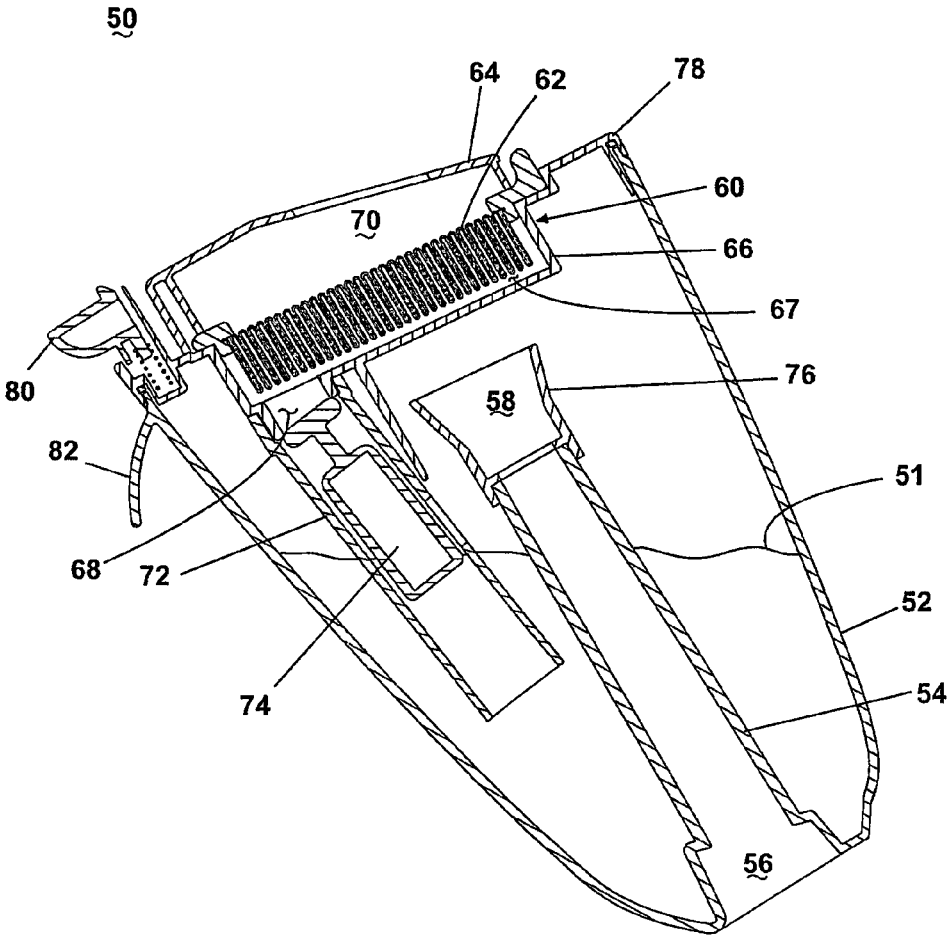
FIG. 8A is a sectional view similar to FIG. 8 with the recovery tank assembly tilted rearward.
Figure 8B:
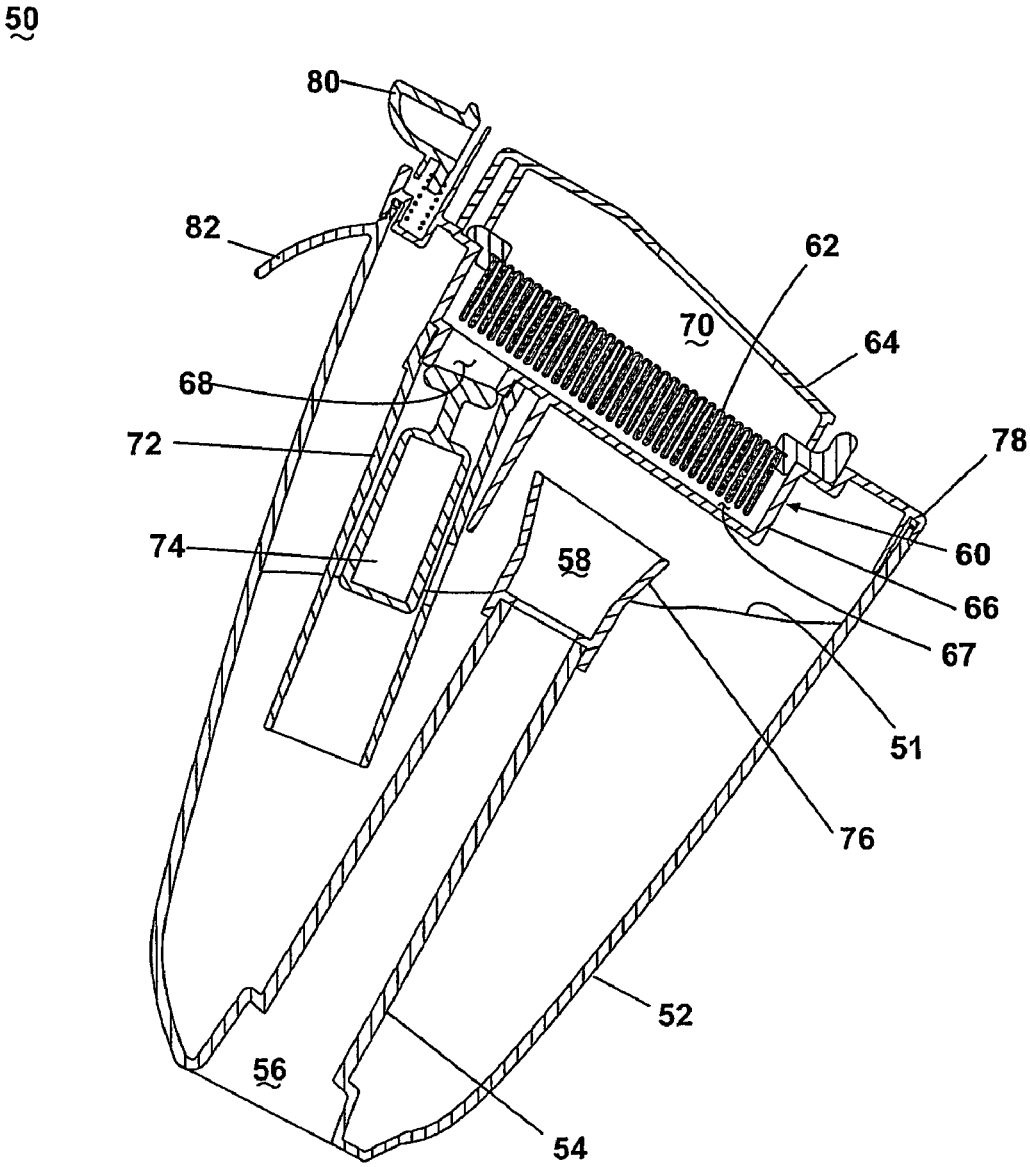
FIG. 8B is a sectional view similar to FIG. 8 with the recovery tank assembly tilted forward.

Arrows shown in FIG. 8 indicate the flow of working air created by the motor/fan assembly 33 through the recovery tank assembly 50. Working air from the foot 14 enters the recovery tank assembly 50 at the inlet 56, travels through the standpipe 54, over the top of the diffuser 76, through the float cage 72, through the inlet aperture 68, through the filter 62, and through the outlet aperture 70 to an inlet on the motor/fan assembly 33. Heavier debris and liquid separate from the air stream when the working air passes over the diffuser 76 and hits the bottom wall 66 of the lid 60. The debris and liquid removed from the air stream fall to a lower portion of the tank 52, where they are stored until the recovery tank 52 is emptied by the user.

Figure 9:
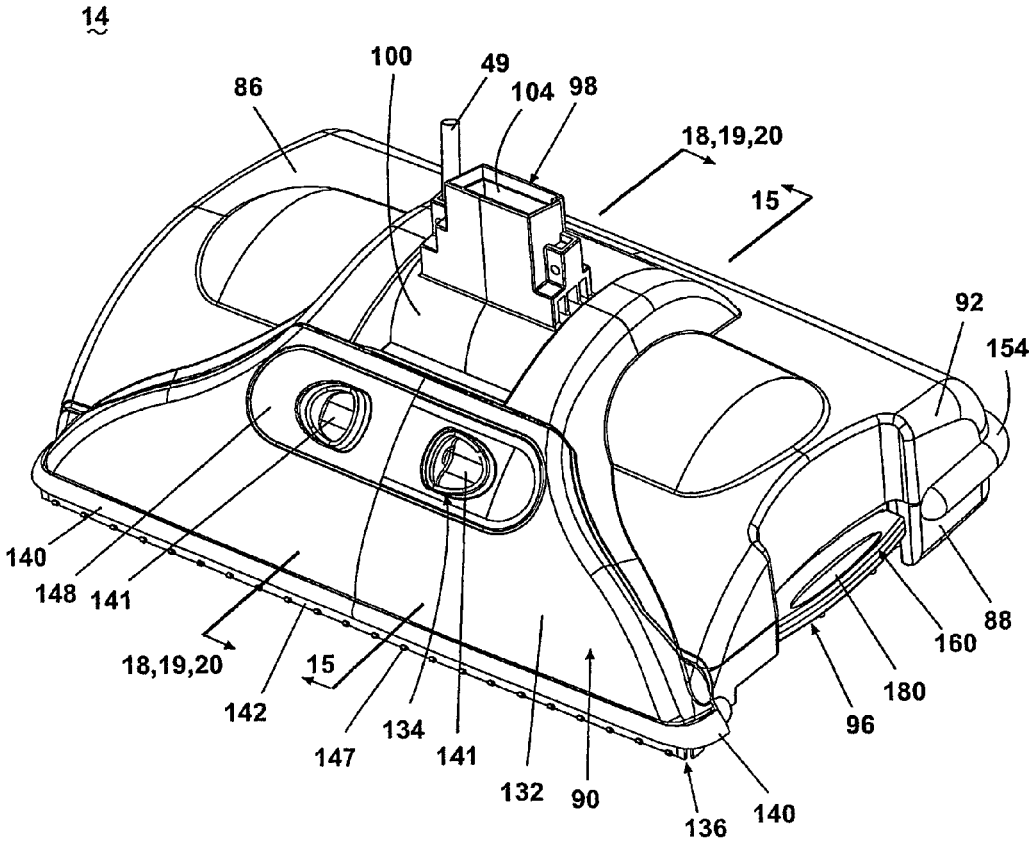
FIG. 9 is a front perspective view of the foot assembly of the bare floor cleaner shown in FIG. 1 and comprising wet and dry nozzle assemblies.
Figure 10:
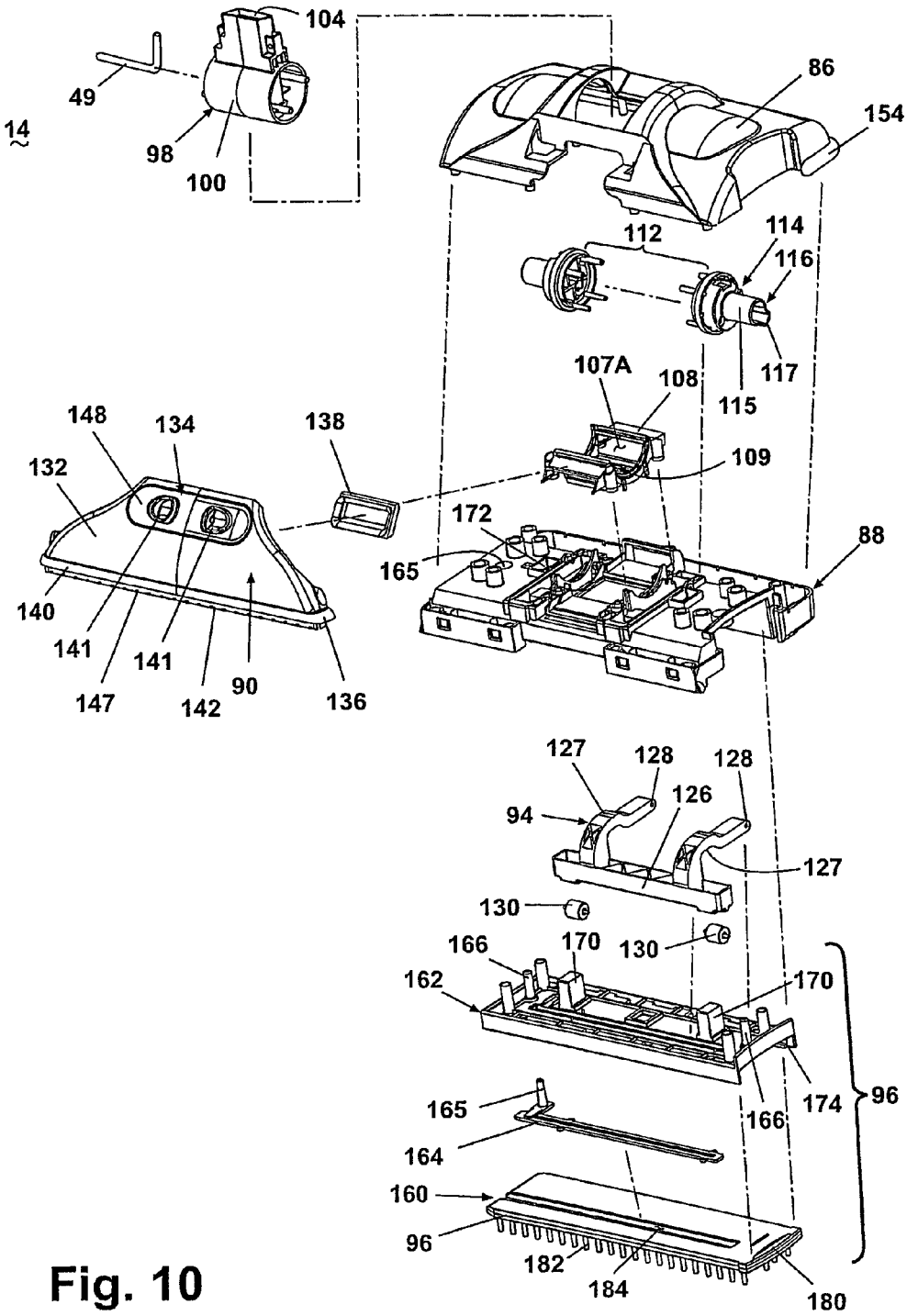
FIG. 10 is an exploded view of the foot assembly shown in FIG. 9.

Referring to FIGS. 9-10, the foot assembly 14 comprises a top enclosure 86 mounted to a frame 88 to define a cavity therebetween that houses several components of the foot assembly 14. The frame 88 provides structural support for several of the foot assembly components, such as a handle pivot 98 for pivotally mounting the handle assembly 12 to the foot assembly 14, wet and dry nozzle assemblies 90, 92 on opposite sides of the foot assembly 14 for suctioning wet and dry debris, respectively, from the surface to be cleaned, a vertically adjustable wheel carriage assembly 94, and an agitator assembly 96.

Figure 11:
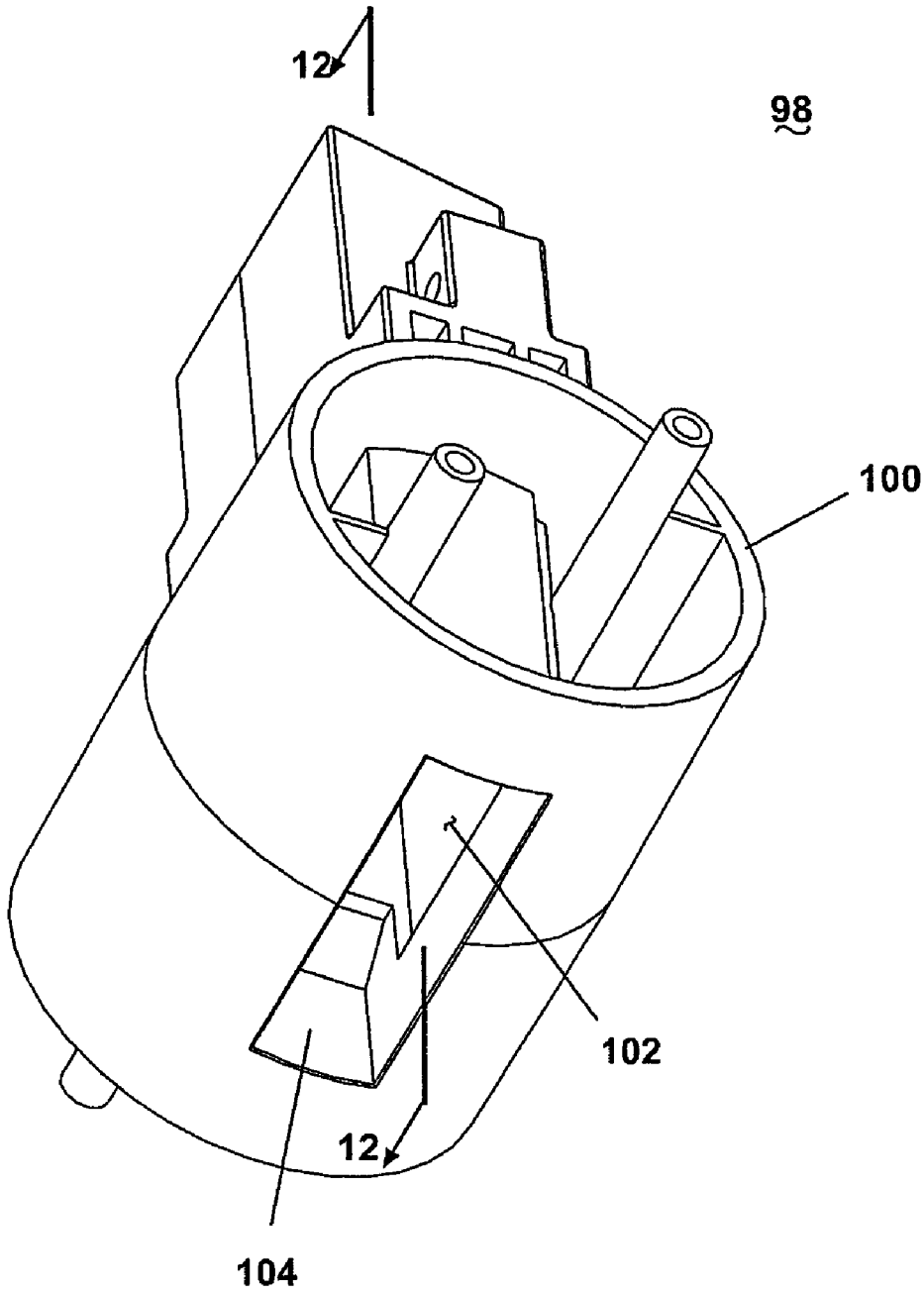
FIG. 11 is a perspective view of a handle pivot from the foot assembly shown in FIG. 9.
Figure 12:
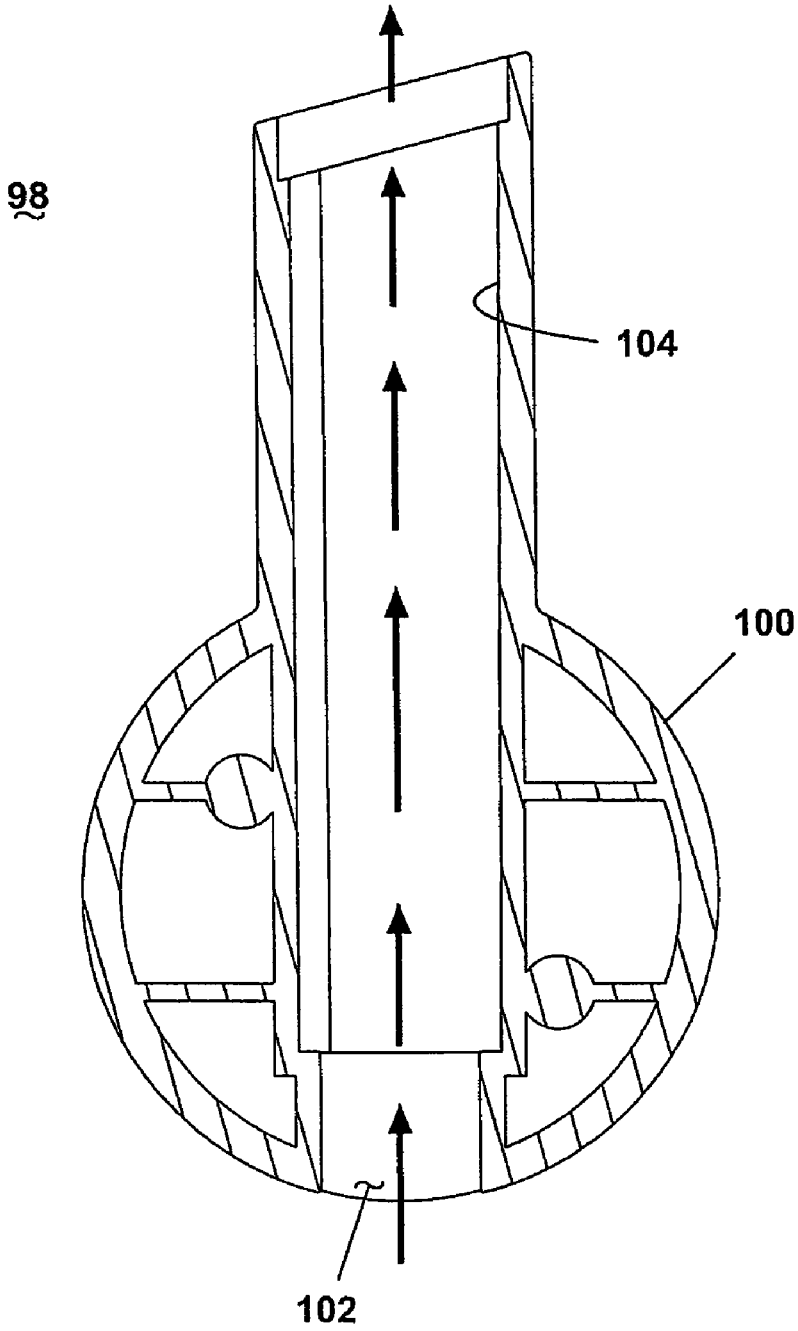
FIG. 12 is a sectional view taken along line 12-12 of FIG. 11.
Figure 13:
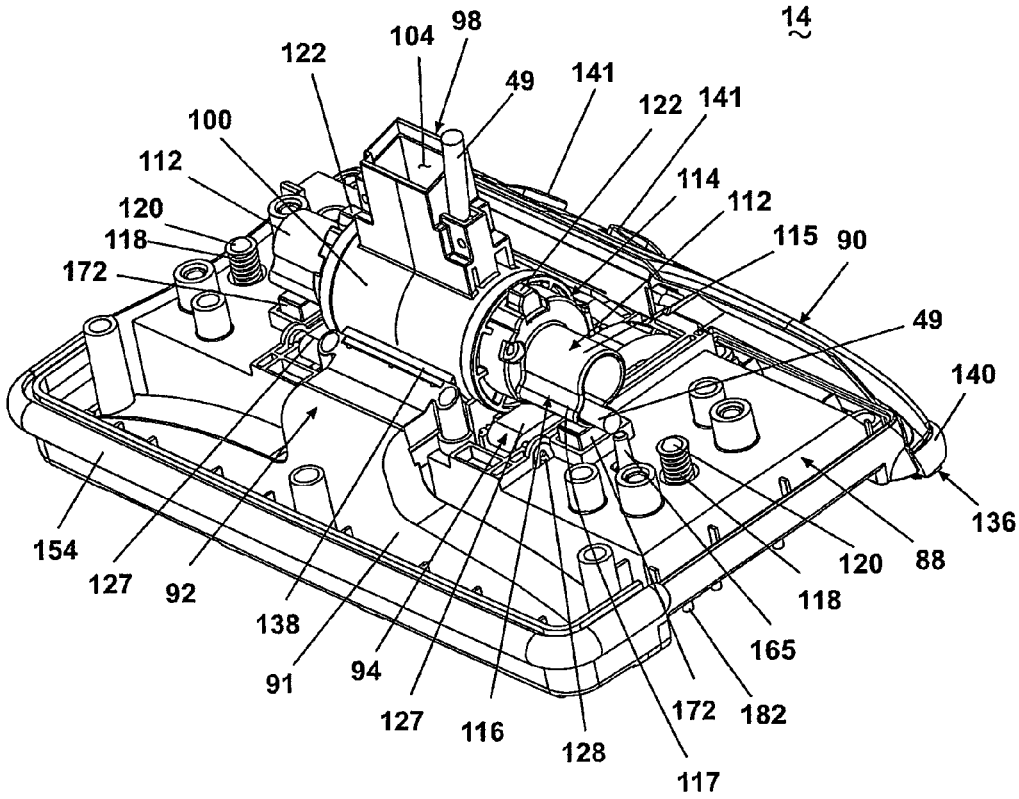
FIG. 13 is a perspective view of the foot assembly shown in FIG. 9 with a top enclosure removed.
Figure 14:
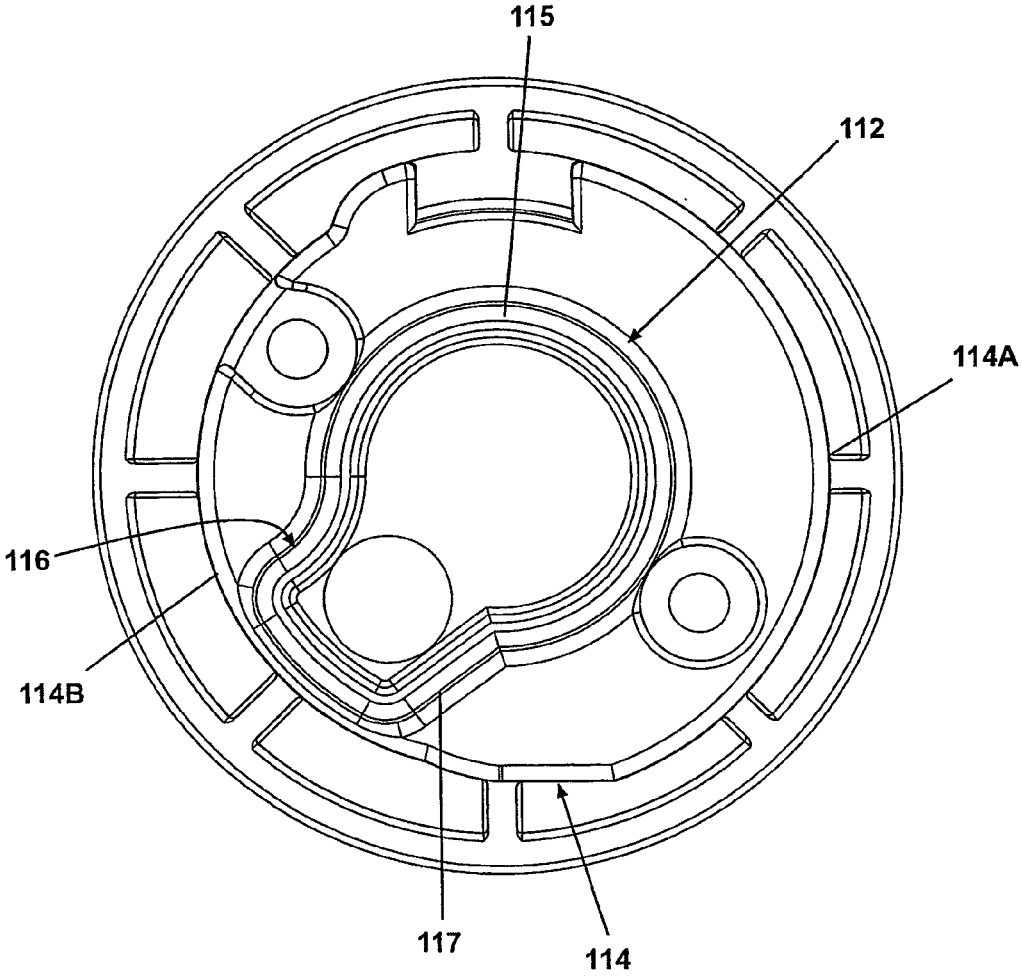
FIG. 14 is a side view of a cam assembly from the foot assembly shown in FIG. 9.

Referring additionally to FIGS. 11-13, the handle pivot 98 comprises a barrel 100 with a longitudinal inlet aperture 102 formed in a sidewall thereof. A generally rectangular conduit 104 extends from the aperture 102 and diametrically through the barrel 100 and projects radially outward from another sidewall portion of the barrel 100 to define an air flow path through the handle pivot 98 and an outlet therefor. The handle pivot 98 is retained on the pivot cradle 108 by the top enclosure 86 when it is mated with the frame 88. The conduit 104 projects through the top enclosure 86 and is received by the conduit 31 with a seal 35 therebetween to connect the handle assembly 12 to the handle pivot 98. Hence, the air flow path extends from the handle pivot 98 and through the conduit 31 to the recovery tank assembly 50. In the foot assembly 14, the handle pivot 98 rests on and rotates over a pivot cradle 108 mounted to the frame 88. The pivot cradle 108 has a central longitudinal plug 109 positioned between two apertures 107A, 107B and sized to mate with and block the aperture 102. Because the conduit 31 of the lower handle 18 receives the conduit 104 of the handle pivot 98, the handle pivot 98 rotates within the pivot cradle 108 when the handle assembly 12 pivots relative to the foot assembly 14.

Referring to FIGS. 10 and 13-15, a cam assembly 112 is fixedly attached to each end of the barrel 100 of the handle pivot 98 for rotation therewith. The cam assembly 112 comprises a wheel carriage lobe 114 that interfaces with the wheel carriage assembly 94 and an agitator lobe 116 that interfaces with the agitator assembly 96. The wheel carriage lobe 114 is generally circular and comprises a first portion 114A with a first radius and a second portion 114B with a second radius that is less than the first radius. The agitator lobe 116 comprises a circular shaft 115 with a generally rectangular radial projection 117. Additionally, a detent plunger 122 extends through an outer periphery of each cam assembly 112, as best viewed in FIG. 15. Each plunger 122 is radially oriented within the cam assembly 112 and is biased radially outward by a detent spring 121. The end of the plunger 122 that projects beyond the cam assembly 112 is ramped to correspond with a detent recess (not shown) in the top enclosure 86. The detent plunger 122 resides with the detent recess to maintain the handle assembly 12 in the upright, or storage, position (i.e., the handle position indicated by the number 3 in FIG. 15). When the handle assembly 12 rotates in the pivot cradle 108 from the upright position, interaction between the ramped end and the top enclosure 86 overcomes the bias of the spring 121 and pushes the detent plunger 122 into the cam assembly 112 so that the handle assembly 12 can pivot into either the first or second position.

The wheel carriage assembly 94 comprises a generally U-shaped frame formed by an elongated wheel support 126 and a pair of spaced, L-shaped arms 127. The support 126 carries a plurality of wheels 130 on a lower side thereof, and the entire frame can pivot about pivot pins 128 that extend through the arms 127 at an end opposite the support 126. When the frame pivots about the pivot pins 128, the support 126 raises and lowers the wheels 130 relative to the foot assembly 14. The wheel carriage assembly 94 is mounted to the frame 88 such that an upper surface of the arms 127 abuts the wheel carriage lobes 114 of the cam assembles 112 to form the above mentioned interface.

Figure 15:
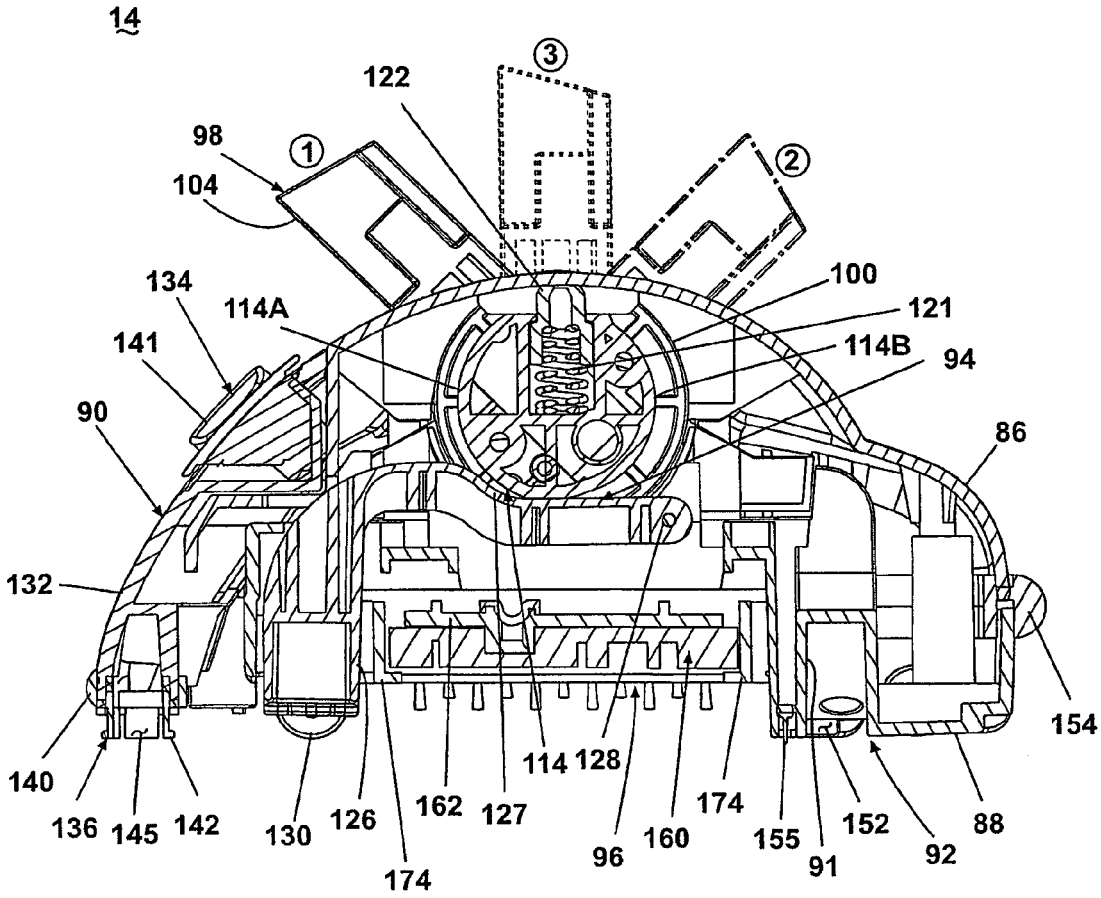
FIG. 15 is a sectional view of the foot assembly taken along line 15-15 of FIG. 9.
Figure 16:
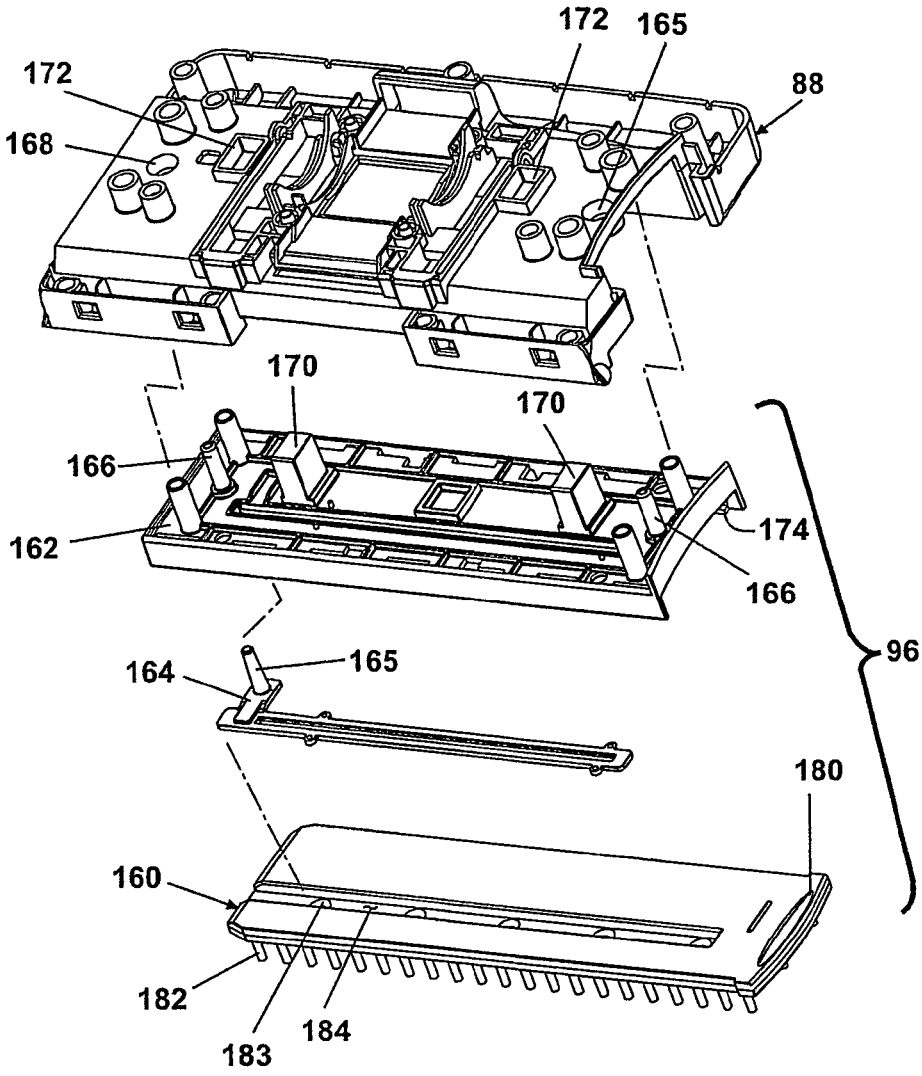
FIG. 16 is an exploded view of an agitator assembly from the foot assembly shown in FIG. 9.
Figure 16A:
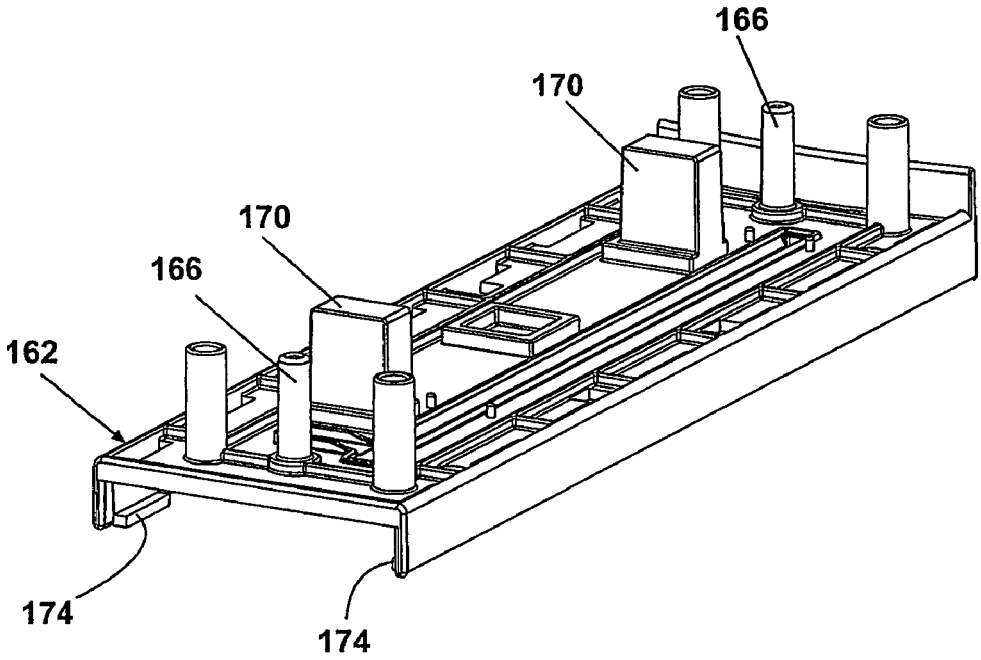
FIG. 16A is a perspective view of a scrubbing support from the agitator assembly shown in FIG. 16.

Referring particularly to FIG. 15, rotation of the handle assembly 12 between the first and second positions induces rotation of the handle pivot 98 and, thus, the cam assemblies 12. When the cam assemblies 12 are positioned such that the first portion 114A of the wheel carriage lobe 114 abuts the arms 127 of the wheel carriage assembly 94, the wheel carriage lobe 114 applies a downward force to the wheel carriage assembly 94 to lower the wheels 130 and effectively raise the wet nozzle assembly 90 off the surface to be cleaned. This configuration corresponds to a dry operational mode for the bare floor cleaner 10 and is achieved when the handle assembly 12, which is connected to the handle pivot 98, rotates towards the wet nozzle assembly 90 to the first position (i.e., the handle position indicated by the number 1 in FIG. 15). When the handle assembly 12 is in the first position, the dry nozzle assembly 92 is in front of the wet nozzle assembly 90, and the inlet aperture 102 is aligned with the aperture 107A. When the handle assembly 12 rotates in the opposite direction to the second position (i.e., the handle position indicated by the number 2 in FIG. 15), the second portion 114B of the wheel carriage lobe 114 abuts the wheel carriage assembly 94. Because the radius of the second portion 114B is smaller than the radius of the first portion 114A, the wheel carriage assembly 94 raises within the foot assembly 14 and away from the surface to be cleaned. As a result, the wet nozzle assembly 92 is effectively lowered and contacts the surface to be cleaned. When the handle assembly 12 is in the second position, the wet nozzle assembly 90 is in front of the dry nozzle assembly 92, and the inlet aperture 102 is aligned with the aperture 107B. This configuration corresponds to a wet mode of the bare floor cleaner 10.

Referring now to FIGS. 10, 13, 16, and 16A, the agitator assembly 96 comprises a scrubbing plate 160, a scrubbing support 162, and a fluid distributor bar 164. The scrubbing support 162 comprises a plurality of alignment pins 166 and engagement blocks 170 that respectively correspond with a plurality of alignment pin apertures 168 and engagement block apertures 172 in the foot assembly frame 88. A dimensional clearance between the engagement blocks 170 and the engagement block apertures 172 enables lateral displacement of the scrubbing plate 160 for enhanced agitation of the surface to be cleaned for improved cleaning performance. The scrubbing support 162 is secured to foot assembly frame 88 by retainers 120 positioned on the pins 166. Springs 118 surround the pins 116 between the retainers 120 and the frame 88, which can be seen in FIG. 13, to bias the scrubbing support 162 against the undersurface of the frame 88. The agitator assembly 96 is mounted to the frame 88 such that an upper surface of the engagement blocks 170 abuts the agitator lobes 116, which mechanically connect the handle pivot 98 to the agitator assembly 96. Furthermore, the scrubbing support 162 incorporates a pair of slide rails 174 for removably mounting the scrubbing plate 160 thereto.

The scrubbing plate 160 is slidingly received between the slide rails 174 and comprises a plurality of downwardly facing agitation bristles 182, a fluid bar recess 184, and a finger grip 180. The finger grip 180 is integrally formed on a side edge surface of the scrubbing plate 160 to facilitate removal of the scrubbing plate 160 from the scrubbing support 162. The fluid bar recess 184 supports the fluid bar 164, which has a fitting 165 in fluid communication with the flexible conduit 49 that receives fluid from the solution tank assembly 40. Fluid from the flexible conduit 49 enters the fluid distributor bar 164 through the fitting 165, and the fluid is distributed through openings 183 in the scrubbing plate 160 to the surface to be cleaned.

A sponge pad or any suitable agitation device such as an abrasive cloth can be attached to the scrubbing plate 160 in place of or in addition to the bristles 182. The bristles 182 can be of uniform or varying size, shape, and flexibility. In one embodiment, short, stiff bristles are interspersed among long, flexible bristles to thereby provide a soft brush for delicate surfaces and rigid brush for more aggressive cleaning. The stiff bristles and soft bristles can be arranged in alternating, juxtaposed rows. The stiff bristles contact the surface to be cleaned when a downward force is applied to the bare floor cleaner 10. A variety of agitation devices can be used and interchanged according to the type of surface to be cleaned and the action to be performed on the surface to be cleaned.

Figure 19:
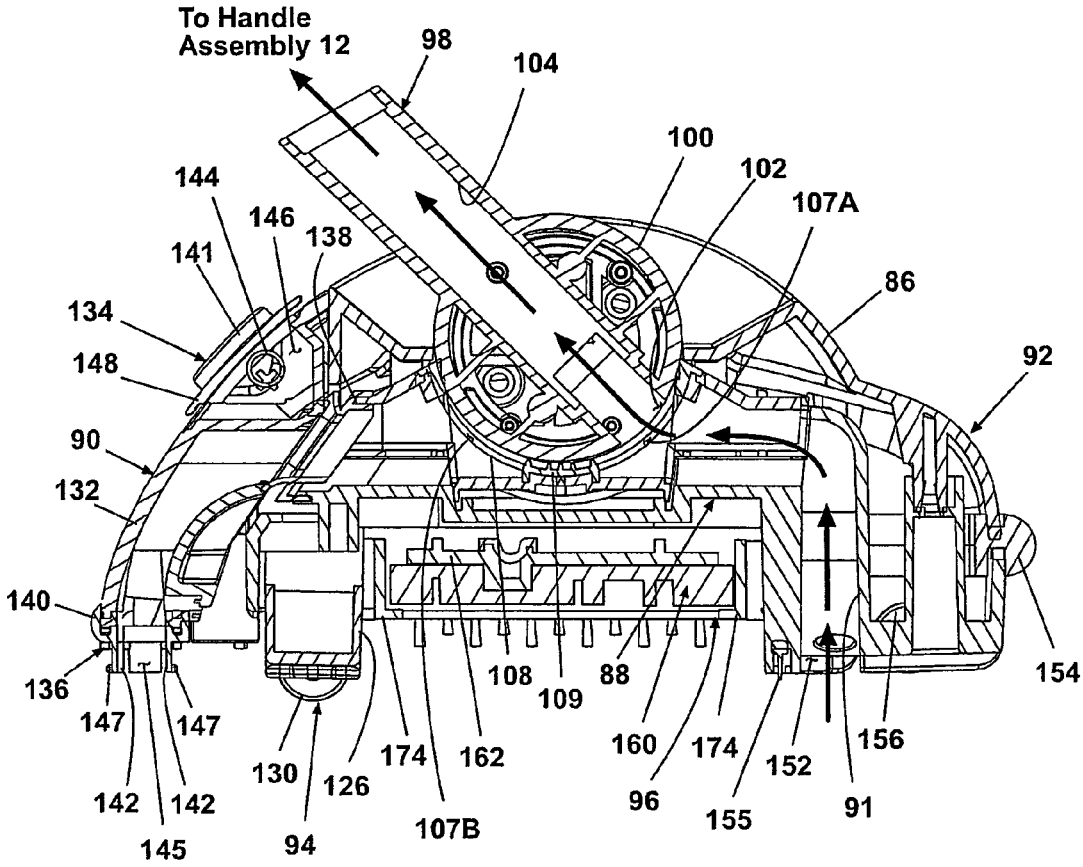
FIG. 19 is a sectional view taken along line 19-19 of FIG. 9, wherein the bare floor cleaner is in a dry mode.
Figure 20:
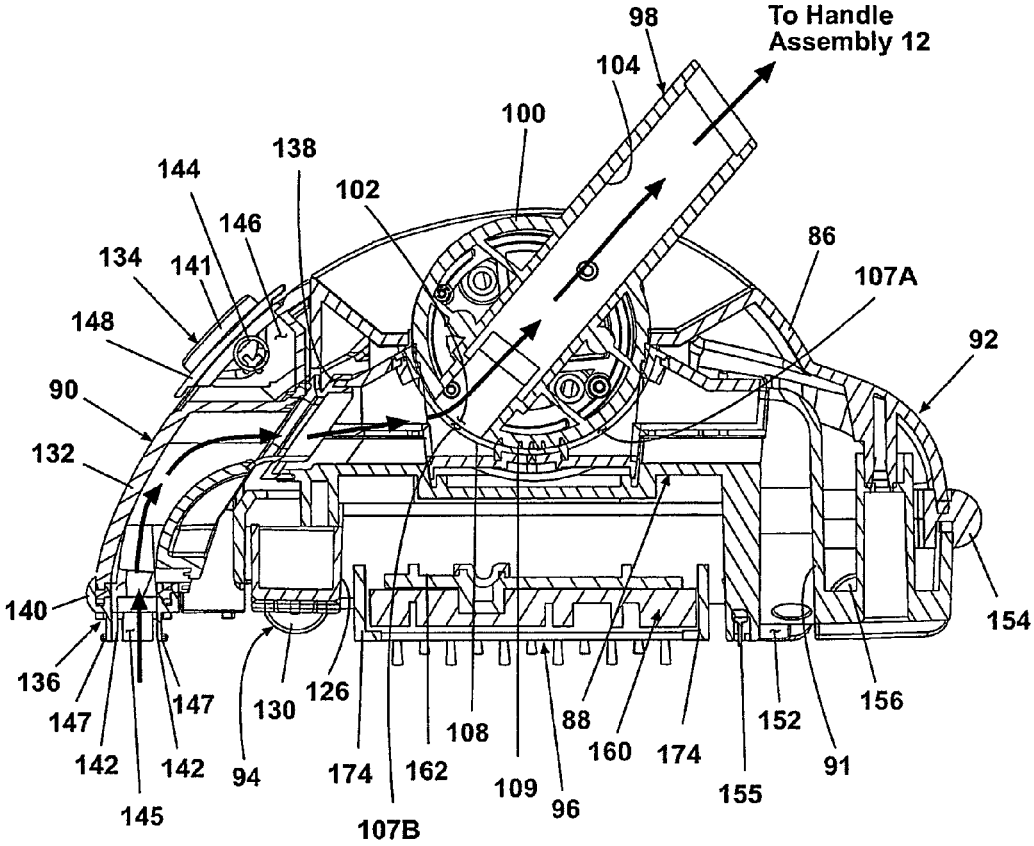
FIG. 20 is a sectional view similar to FIG. 19, wherein the bare floor cleaner is in a wet mode.

Referring particularly to FIGS. 13, 19, and 20, when the handle assembly 12 rotates between the first and second positions, the agitator lobes 116 on the cam assemblies 12 rotate to vertically displace the agitator assembly 96. When the handle assembly 12 is in the first position, wherein the dry nozzle assembly 92 is in front of the wet nozzle assembly 90, the shafts 115 of the agitator lobes 116 abut the engagement blocks 170 of the agitator assembly 96. In this position, the springs 118 pull the scrubbing support 162 into abutting contact with the foot assembly frame 88 to raise the agitator assembly 96 from the surface to be cleaned. The agitator assembly is thus biased to a raised position, wherein the bristles 182 are positioned above the surface to be cleaned. When the handle assembly 12 rotates to the second position, wherein the wet nozzle assembly 90 is in front of the dry nozzle assembly 92, the projections 117 of the agitator lobes 116 abut the engagement blocks 170 of the agitator assembly 96 and thereby force the agitator assembly 96 downward against the bias of the spring 118 to a lowered position, wherein the bristles 182 are in contact with the surface to be cleaned. The agitator assembly 96 is positioned directly under the handle pivot 98 and is dimensioned so that the full weight of the bare floor cleaner 10 is supported by the agitator assembly 96 when the handle assembly 12 is in the second position and the bare floor cleaner 10 is in the wet mode. The user can easily apply additional force on the agitator assembly 96 by applying downward force to the handle assembly 12.

Figure 17:
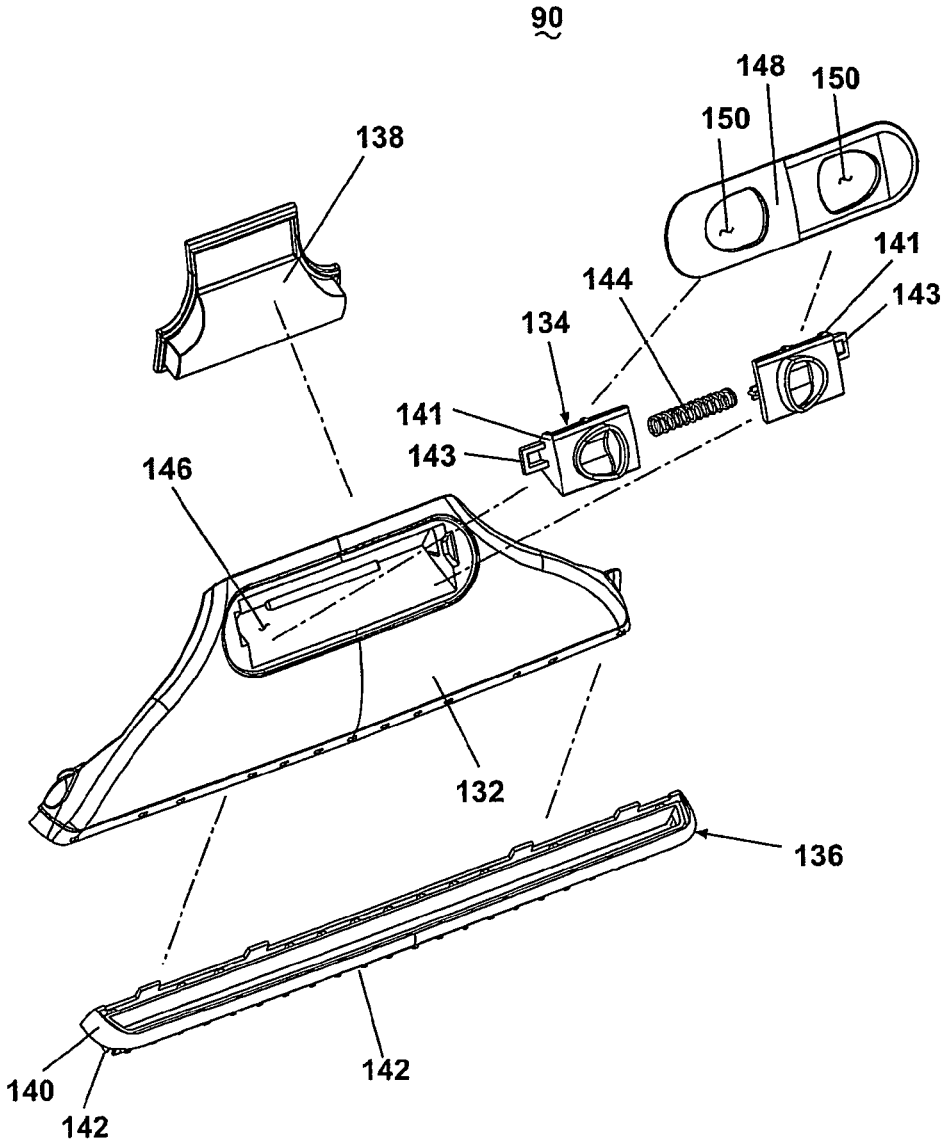
FIG. 17 is an exploded view of the wet nozzle assembly shown in FIG. 9.

Referring to FIGS. 10 and 17, the wet nozzle assembly 90 comprises a wet nozzle housing 132 and a latch mechanism 134 disposed in a latch recess 146 on the wet nozzle housing 132 for removably mounting the wet nozzle assembly 90 to the foot assembly 14. The wet nozzle housing 132 forms a suction conduit that defines a working air path that extends from a wet suction nozzle opening 145 at a lower end of the wet nozzle housing 132 to an outlet at an upper end of the wet nozzle housing 132. To facilitate attaching the wet nozzle assembly 90 to and removing it from the foot assembly 14, the wet nozzle housing 132 further comprises a plurality of protruding hooks (not shown) located on a rearward surface of the wet nozzle housing 132 above the wet suction nozzle opening 145. The hooks are sized to be received by corresponding slots (not shown) in the foot assembly 14. When the wet nozzle assembly 90 is mounted to the foot assembly 14, the outlet is aligned with the aperture 107B in the pivot cradle 108. A gasket 138 positioned between the wet nozzle housing 132 and the pivot cradle 108 seals the working air path at the juncture therebetween.

The wet suction nozzle opening 145 is surrounded by a dual squeegee assembly 136 that contacts the surface to be cleaned when the bare floor cleaner 10 is in the wet mode. The dual squeegee assembly 136 comprises an integral bumper 140 and a pair of parallel squeegees 142 that extend down from the wet nozzle housing 132. The squeegees 142 comprise a plurality of nubs 147 on their outer surfaces and are flat on their inner surfaces. During use, as the bare floor cleaner 10 moves forward, the forward squeegee 142 is biased in a rearward direction, thereby placing its nubs 147 on the surface to be cleaned and creating airspace between the nubs 147. The rearward squeegee 142 is also biased in a rearward direction such that its flat inner surface contacts the surface to create a seal therebetween at the rear of the wet suction nozzle opening 145. When the bare floor cleaner 10 moves backwards, the squeegees 142 flex in a forward direction. As a result, the rearward squeegee 142 rests on its nubs 147 while the flat inner surface of the forward squeegee 142 contacts the surface to create a seal therebetween. The dual squeegee assembly 136 allows surface liquid to pass between the nubs 147 while maintaining high lift through the wet suction nozzle opening 145 and leaves the surface relatively dry upon completion of wet suction. The bumper 140 on the squeegee assembly 136 prevents damage to furniture and other objects as the bare floor cleaner 10 moves across the surface to be cleaned.

The wet nozzle assembly 90 is preferably removable from the foot assembly 14 for cleaning or replacement. The wet nozzle assembly 90 is attached to the foot assembly frame 88 by the latch mechanism 134, which comprises a pair of opposing latches 141 forced apart by a latch spring 144 located therebetween. The latches 141 and the latch spring 144 are contained in the latch recess 146 and held in place with a latch cover 148 having a pair of latch apertures 150 through which a user can access the latches 141. Each latch 141 is slidable relative to the wet nozzle housing 132 and comprises a protrusion 143 that is urged by the latch spring 144 through a corresponding aperture in the wet nozzle housing 132 and a corresponding detent 131 in the top enclosure 86 of the foot assembly 14. Interaction of the protrusions 143 and the detents 131 retains the wet nozzle assembly 90 on the foot assembly 14. To disengage the latches 141, the user moves the latches 141 toward one another against the bias of the spring 144 to remove the protrusions 143 from the detents 131. The wet nozzle housing 90 can thereafter be rotated away from the top enclosure 86 about the hooks on the rearward surface of the wet nozzle housing 132 to remove the wet nozzle housing 90 from the foot assembly top enclosure 86 and the frame 88. When the wet nozzle assembly 90 is removed, the user can access the handle pivot 98.

Figure 18:
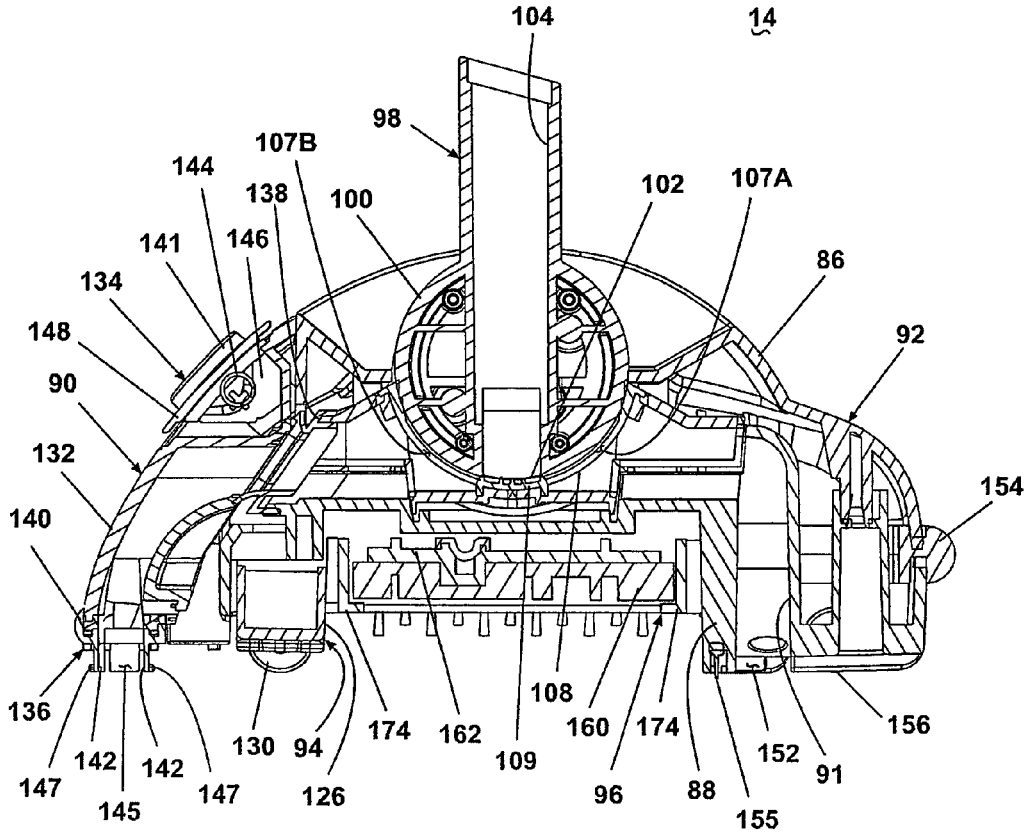
FIG. 18 is a sectional view of the foot assembly taken along line 18-18 of FIG. 9.

Referring to FIGS. 10, 13, and 18, the dry nozzle assembly 92 comprises a dry suction conduit 91 formed on the foot assembly frame 88 on a side opposite the wet nozzle assembly 90. The dry suction conduit 91 forms a working air path between an elongated, transverse dry suction nozzle opening 152 and an outlet at an upper end of the dry suction conduit 91, which is aligned with the aperture 107A in the pivot cradle 108. The foot assembly 14 further comprises a dry nozzle bumper 154 affixed to the top enclosure 86 adjacent the dry nozzle assembly 92, a dry scraper 155 adjacent the dry suction nozzle opening 152, and a pair of fixed wheels 156 mounted to the foot assembly frame 88 between the dry nozzle bumper 154 and the dry suction nozzle opening 152. Furthermore, a plurality of tapered lead-in grooves (not shown) are molded into a bottom surface of the dry nozzle assembly 92 and are configured such that the grooves taper toward the dry suction nozzle opening 152 to guide dust and debris thereto. The shape and location of the grooves promote maximum lift at the dry suction nozzle opening 152 while allowing large debris to pass into the dry suction conduit 91.

When the bare floor cleaner 10 is not in use, the handle assembly 12 is in the vertical upright position, as illustrated in FIG. 18. In this position, the handle pivot 98 is positioned such that the plug 109 in the pivot cradle 108 abuts the aperture 102 in the barrel 100 of the handle pivot 98 to block air flow therethrough. As a result, neither the wet nozzle assembly 90 nor the dry nozzle assembly 92 is in fluid communication with the recovery tank assembly 50 and, thus, the motor/fan assembly 33.

Referring now to FIGS. 19 and 20, the bare floor cleaner 10 is capable of at least two modes of operation: the dry mode (FIG. 19) and the wet mode (FIG. 20). The user switches between modes by rotating the handle assembly 12 between the first and the second positions. As the handle assembly 12 rotates, the handle pivot 98 also rotates and selectively prevents fluid communication between the recovery tank assembly 50 and one of the wet suction nozzle opening 145 and the dry suction nozzle opening 152. Thus, the barrel 100 of the handle pivot 98 functions as a diverter valve that is actuated by pivoting the handle assembly 12. Further, the conduit 104 of the handle pivot 98 not only defines part of the working air conduit, but it also connects the handle assembly 12 with the barrel 100 so that movement of the handle assembly 12 translates into movement of the diverter valve. The conduit 104 of the handle pivot 98, therefore, functions as an actuator that is mounted to the handle assembly 12 and is connected to the diverter (i.e., the barrel 100), as just described, to move the diverter for conversion of the bare floor cleaner 10 between the dry and wet modes.

In the dry mode, the handle assembly 12 is in the first position over the wet nozzle assembly 90 such that the dry nozzle assembly 92 is in a forward position relative to the wet nozzle assembly 90. When the handle assembly 12 is positioned over the wet nozzle assembly 90, as shown in FIGS. 2A and 19, the inlet aperture 102 of the handle pivot 98 is aligned with the aperture 107A in the pivot cradle 108, and the barrel 100 blocks the aperture 107B that is in fluid communication with the wet nozzle assembly 90. As a result, a working air conduit, which is indicated with arrows, extends from the dry nozzle aperture 152, through the dry nozzle assembly 92, through space between the foot assembly frame 88 and the top enclosure 86, through the opening 107A, through the inlet aperture 102, through the rectangular conduit 104 that projects from the pivot barrel 100, and through the conduit 31 to the inlet 56 of the recovery tank 52.

In the dry mode, the handle pivot cam assemblies 112 are oriented such that the first portions 114A of the wheel carriage lobes 114 simultaneously engage the arms 127 of the wheel carriage frame 126 to thereby force the wheel carriage frame 126 away from the foot assembly frame 88 and towards the surface to be cleaned. As a result, the foot assembly frame 88, including the squeegee assembly 136 on the wet nozzle assembly 90, is raised from the surface to be cleaned. At the same time, the shafts 115 of the agitator lobes 116 abut the engagement blocks 170 of the agitator assembly 96 so that the springs 118 raise the scrubbing plate 162 from the surface to be cleaned.

With the handle assembly 12 in the first position, the user grasps the first portion 22A of the grip 22 and moves the bare floor cleaner 10 across the surface to be cleaned. Dirt and debris near the dry suction nozzle opening 152 enters the dry nozzle assembly 92 therethrough and flows through the working air conduit to the recovery tank 52, where it is separated from the working air and deposited into the recovery tank 52. Thereafter, the working air continues to flow through the float cage 72, the inlet aperture 68, and the filter 62 before entering the motor/fan assembly 33.

Referring now to FIGS. 2A and 20, in the wet mode, the handle assembly 12 is in the second position over the dry nozzle assembly 92 such that the wet nozzle assembly 90 is in front of the dry nozzle assembly 92. When the handle assembly 12 is in the second position, the inlet aperture 102 of the handle pivot 98 is aligned with the aperture 107B in the pivot cradle 108, and the barrel 100 blocks the aperture 107A that is in fluid communication with the dry nozzle assembly 92. As a result, a working air conduit, which is indicated with arrows in FIG. 20, extends from the wet nozzle suction opening 145 between the squeegees 142 of the squeegee assembly 136, through the wet suction nozzle assembly 90, through the aperture 107B in the pivot cradle to the handle pivot aperture 102, through the rectangular conduit 104 that extends from the handle pivot barrel 100, and through the conduit 31 to the inlet 56 of the recovery tank 52.

In the wet mode, the handle pivot cam assemblies 112 are oriented such that the second portions 114B of the wheel carriage lobes 114 simultaneously engage the wheel carriage frame 126 to thereby retract the wheel carriage 126 from the surface to be cleaned and towards the foot assembly frame 88. As a result, the foot assembly frame 88, including the wet nozzle assembly 90 and the squeegee assembly 136, is lowered to the surface to be cleaned. Additionally, the projections 117 of the agitator lobes 116 rotate into abutting contact with the engagement blocks 170 of the agitator assembly 96 to lower the scrubbing plate 160 as described previously.

Optionally, cleaning fluid can be dispensed onto the surface to be cleaned when the bare floor cleaner 10 is in the wet mode. Cleaning fluid can be selectively dispensed from the clean solution tank 41 via the trigger 24, which opens the receiver valve assembly 45. Subsequently, cleaning fluid flows by gravity through the fluid conduit 49, the fluid fitting 165, and the fluid bar 164 that is attached to the scrubbing support 162. Ultimately, the cleaning solution travels from the fluid bar 164 to the surface to be cleaned through the openings 183 in the fluid bar recess 184 on the scrubbing plate 160.

With the handle assembly 12 in the second position, the user grasps the second portion 22B of the grip 22 and moves the bare floor cleaner 10 across the surface to be cleaned. Soiled cleaning fluid and wet dirt and debris collected by the squeegee assembly 136 near the wet suction nozzle opening 145 enters the wet nozzle assembly 90 therethrough and flows through the working air conduit to the recovery tank 52, where it is separated from the working air and deposited into the recovery tank 52. Thereafter, the working air continues to flow through the float cage 72, the inlet aperture 68, and the filter 62 before entering the motor/fan assembly 33. Because the float cage 72 and the inlet aperture 68 are positioned above the standpipe 54, the amount of liquid required to close the shut-off valve is greater than when the bare floor cleaner 10 is in the dry mode.

Figure 21:
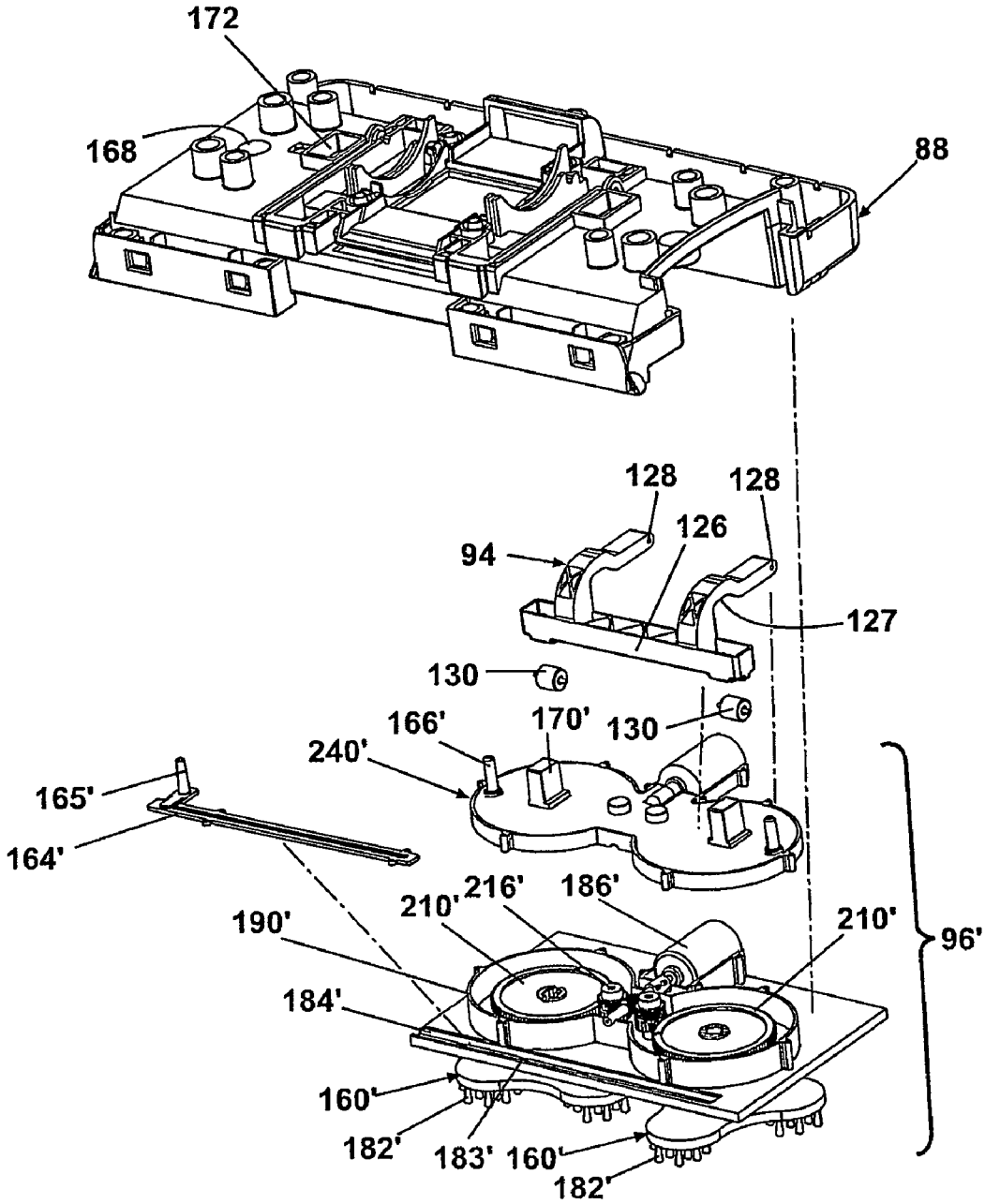
FIG. 21 is an exploded view of a frame from the foot assembly shown in FIG. 10 and an alternative agitator assembly.
Figure 22:
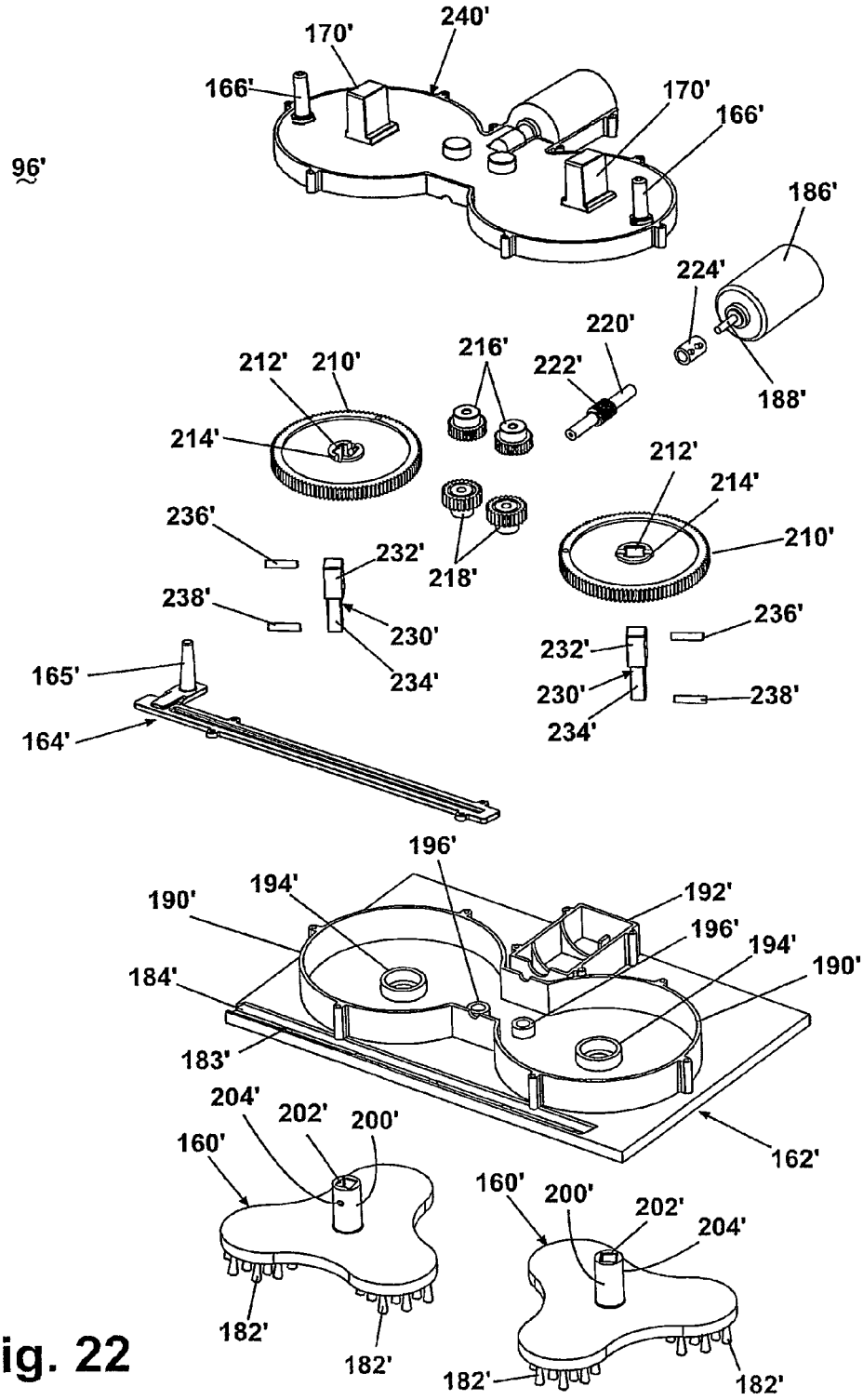
FIG. 22 is an exploded view of the alternative agitator assembly shown in FIG. 22.

An alternative agitator assembly 96' is illustrated in FIGS. 21 and 22, where components similar to those of the previous embodiment are labeled with the same reference numeral bearing a prime (') symbol. The agitator assembly 96' comprises a pair of scrubbing plates 160' rotatably mounted to a scrubbing support 162' coupled to the frame 88 of the foot assembly 14. Each of the scrubbing plates 160' carries a plurality of bristles 182' for agitating the surface to be cleaned and comprises three arcuate lobes 206', wherein the center points of the lobes 206' are arranged in an equilateral triangle configuration. Additionally, each scrubbing plate 160' includes an upstanding shaft 200' that defines a vertical axis and includes a central keyed longitudinal channel 202' and a transverse pinhole 204'. The scrubbing plates 160' are rotationally offset from one another such that one lobe 206' of one scrubbing plate 160' is received between two adjacent lobes 206' of the other scrubbing plate 160' in the region between the scrubbing plates 160'. This arrangement ensures that the bristles 182' are continuous across the agitator assembly 96'.

As in the first embodiment agitator assembly 96, the scrubbing support 162' comprises a fluid bar recess 184' sized to receive the fluid bar 164 and includes a plurality of openings 183' for delivering fluid through the scrubbing support 162' and onto the surface to be cleaned. Further, a motor housing 192' on an upper surface of the scrubbing support 162' holds an agitator motor 186' having a drive shaft 188'. The scrubbing support 162' also has a gear housing 190' with a pair of first bearings 194' that surround apertures in the scrubbing support 162' and a pair of second, smaller bearings 196' between the first bearings 194'.

The gear housing 190' supports a gear assembly that mechanically couples the scrubbing plates 160' to the agitator motor 186'. The gear assembly comprises a pair of agitator spur gears 210' situated on the first bearings 194' and having a longitudinal keyed aperture 212' and a pin depression 214'. The teeth of each agitator spur gear 210' mesh with those of a lower spur gear 218' seated on one of the second bearings 196'. Each lower spur gear 218' is fixedly attached to upper spur gears 216' for rotation therewith. The motor drive shaft 188' is connected to a drive rod 220' by a collar 224'. The drive rod 220' rotates with the drive shaft 188' and is equipped with a worm gear 222' situated between the upper spur gears 216'. As with conventional worm gear drive arrangements, a commonly known thrust bearing (not shown) positioned between the drive rod 220' and the motor housing 192' absorbs lateral loads applied by the worm gear 222' to the agitator motor 186'.

Each of the scrubbing plates 160' is mounted to the scrubbing support 162' and mechanically connected to their respective agitator spur gear 210' by an axle 230' having upper and lower portions 232', 234'. The upper and lower portions 232', 234' both have square transverse cross-sections sized for receipt within the keyed apertures 212' in the agitator spur gears 210' and the keyed longitudinal channels 202' of the scrubbing plate shafts 200', respectively, and the upper portions 232' are larger than the keyed longitudinal channels 202'. To mount the scrubbing plates 160' to the scrubbing support 162', the axles 230' are inserted into the keyed apertures 212', through the apertures surrounded by the first bearings 194' until the lower portions 234' are received by the keyed longitudinal channels 202'. Further movement of the axles 230' is limited by the relative size of the upper portions 232' relative to the keyed longitudinal channels 202'. The axles 230' are secured in place by first pins 236' that extend through the upper portions 232' and reside in the pin depressions 214' and second pins 238' that extend through the lower portions 234' and the pinholes 204'.

The agitator assembly 96' further comprises a cover 240' removably mounted to the gear housing 190'. The cover 240' includes, on its lower surface, a set of bearings (not shown) that correspond to the second bearings 196' for the upper spur gears 216' and, on its upper surface, upwardly projecting alignment pins 166' and engagement blocks 170'. The alignment pins 166' and the engagement blocks 170' are received by the alignment pin apertures 168 and the engagement block apertures 172 in the same manner as described above for the first embodiment agitator assembly 96. Additionally, the agitator assembly 96' is biased away from the surface to be cleaned and vertically adjustable in the same fashion as described previously for the first embodiment.

In operation, the agitator assembly 96' can be employed during the wet mode of the bare floor cleaner 10 and is lowered to the surface to be cleaned by rotation of the handle assembly 12 to the second position as described previously with respect to the first embodiment. When power is supplied to the agitator motor 186' either automatically upon rotation of the handle assembly 12 or manually through a switch located on the handle assembly 12 or the foot assembly 23, the motor shaft 188' rotates, which induces rotation of the collar 224' and the drive rod 220'. As the drive rod 220' rotates, the worm gear 222' causes the upper spur gears 216' to rotate in opposite directions. The lower spur gears 218' rotate with the upper spur gears 216' and induce rotation of the agitator spur gears 210' in opposite directions. Because the axles 230' are keyed, the agitator spur gears 210' drive the scrubbing plates 160' such that the scrubbing plates 160' rotate in opposite directions relative to one another and agitate the surface to be cleaned.

Alternatively, the agitator assembly 96' can be adapted such that the scrubbing plates 160' rotate in the same direction. Further, each scrubbing plate 160' can have its own agitator motor 186', or the agitator motor 186' can be offset to one side of the scrubbing support 162' to drive one of the scrubbing plates 160', which, in turn, can drive the other scrubbing plate 160' through a series of gears or belts. Optionally, the agitator assembly 96' can comprise only one scrubbing plate 160' or a plurality of scrubbing plates 160'. In an alternative embodiment, the scrubbing plate 160' can comprise individual circulate plates at each lobe that can rotate independent of the scrubbing plate 160'. The individual circular plates can be geared to the scrubbing plates 160' in a planetary gear fashion so that they are driven as the scrubbing plates 160' rotate. Alternatively, the individual circular plates can be pinned to the scrubbing plates 160' and can rotate freely as the scrubbing plates 160' rotate. Further, the scrubbing plate 160' can comprise any suitable number of lobes and is not limited to the three lobes shown in FIGS. 20 and 21.

Various modifications can be made to the agitator assembly 96' without departing from the scope of the invention. For example, to mount the scrubbing plates 160' to agitator gear 210' or a drive shaft, the scrubbing plates 160' can snap fit into a collar connected to the agitator gear 210' or the drive shaft to from a connection much similar to a connection between a beater and a conventional hand mixer. Such a mechanism can comprise a groove on the upstanding shaft 200' that engages with a spring ring or similar component in a receiving portion of the agitator gear 200' or the drive shaft. Additionally, the scrubbing plates 160' can be vertically displaced relative to the foot assembly 14' by a pivoting mechanism controlled manually or by rotation of the handle assembly 12. Further, while the preferred embodiment of the agitator assembly 96' has been described as comprising a vertical axis rotatable brush, it is within the scope of the invention to utilize commonly known movable brushes such as horizontally oriented brush rolls, reciprocating pads, or orbital motion devices.

Figure 23:
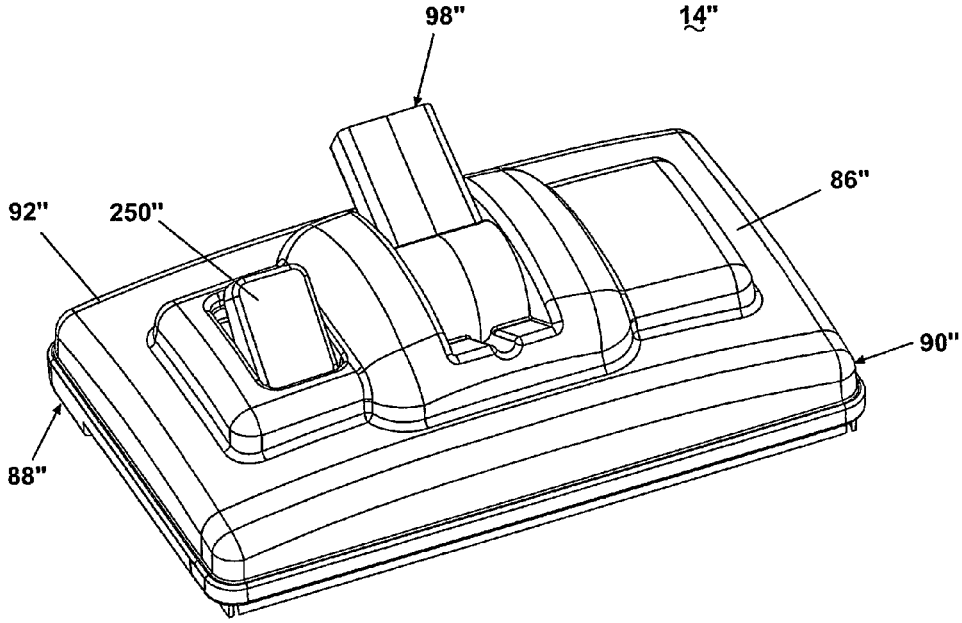
FIG. 23 is a front perspective view of an alternative foot assembly for the bare floor cleaner shown in FIG. 1.
Figure 24:
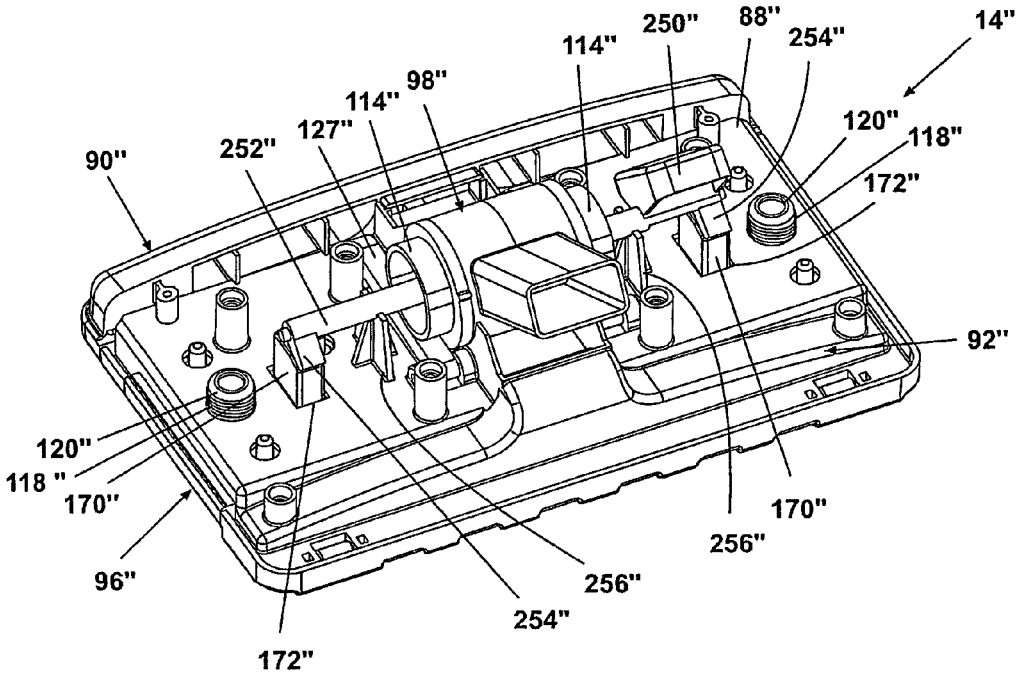
FIG. 24 is a rear perspective view of the alternative foot assembly shown in FIG. 23 with a top enclosure removed.

An alternative foot assembly 14" for the bare floor cleaner is illustrated in FIGS. 23 and 24, where components similar to those of the previous embodiments are labeled with the same reference numeral bearing a double prime (") symbol. The foot assembly 14" is similar to the first embodiment foot assembly 14, except that the present embodiment comprises a fixed wet nozzle assembly 90", and the vertical position of the agitator assembly 96" is adjusted manually by the user with a manually operated pedal 250" that extends through the top enclosure 86".

The pedal 250" is fixedly attached to a shaft 252" having a cam arm 254" disposed on each end thereof. The shaft 252" extends through and can rotate independent of and relative to the handle pivot 98". The shaft 252" rests on a pair of shaft supports 256" located on an upper surface of the foot assembly frame 88", and the cam arms 254" abut the engagement blocks 170" that project through the engagement block apertures 172" in the frame 88". As in the previous embodiments, the agitator assembly 96" is biased towards the frame 88" by the springs 118" that surround the alignment pins 166" between the retainers 120" and the frame 88". When the user depresses the pedal 250" with a foot or a hand, the pedal 250" pivots and thereby rotates the shaft 252" and the cam arms 254" towards the frame 88". As a result, the cam arms 254" apply a downward force to the engagement blocks 170" to move the agitator assembly 96" towards the surface to be cleaned. The foot assembly 14" can further comprise a detent system (not shown) for retaining the pedal in the depressed condition until released by the user.

The invention has been disclosed with respect to a bare floor cleaner with two different types of agitator. The term "agitator" is used herein in a broad sense to mean any type of implement that will scrub a bare floor and can include brushes, either stationary or movable with respect to a base, fibrous or cloth pads, sponges and the like. While the invention has been specifically described in connection with certain specific embodiments thereof, it is to be understood that this is by way of illustration and not of limitation. Reasonable variation and combination are possible with the scope of the foregoing disclosure without departing from the spirit of the invention, which is defined in the appended claims.

What is claimed is:

1. A wet/dry bare floor cleaner comprising:

a base;

a handle pivotally connected to the base;

a recovery system comprising:

a wet suction nozzle;

a dry suction nozzle;

a recovery tank for receiving wet and dry debris;

a working air conduit extending from each of the dry suction nozzle and the wet suction nozzle to the recovery tank;

a motor/fan assembly mounted to one of the handle and the base and adapted to create a working air flow in the working air conduit from at least one of the dry suction nozzle and the wet nozzle and to the recovery tank; and a diverter mounted in the working air conduit, movable between a dry suction position and a wet suction position for selectively at least partially blocking working air flow from the wet suction nozzle and the dry suction nozzle, respectively, to the recovery tank, and coupled to the handle such that movement of the handle moves the diverter between the dry suction position and the wet suction position.

2. The wet/dry bare floor cleaner according to claim 1 and further comprising an agitator mounted to the base for vertical movement between a lowered position in contact with the surface to be cleaned and a raised position above the surface to be cleaned for selectively agitating the surface to be cleaned.

3. The wet/dry bare floor cleaner according to claim 2 and further comprising a connector between the agitator and the diverter for moving the agitator between the lowered position and the raised position as the diverter moves between the wet suction position and the dry suction position.

4. A wet/dry bare floor cleaner comprising:

a base;

a handle pivotally connected to the base;

a recovery system comprising:

a wet suction nozzle;

a dry suction nozzle;

a recovery tank for receiving wet and dry debris;

a working air conduit extending from each of the dry suction nozzle and the wet suction nozzle to the recovery tank;

a motor/fan assembly mounted to one of the handle and the base and adapted to create a working air flow in the working air conduit from at least one of the dry suction nozzle and the wet nozzle and to the recovery tank;

a diverter mounted in the working air conduit and movable between a dry suction position and a wet suction position for selectively at least partially blocking working air flow from the wet suction nozzle and the dry suction nozzle, respectively, to the recovery tank; and an actuator mounted to the handle and connected to the diverter to move the diverter between the dry suction position and the wet suction position and including a connector between the handle and the diverter so that the diverter moves between the dry suction position and the wet suction position as the handle rotates between a dry suction position and a wet suction position.

5. The wet/dry bare floor cleaner according to claim 4 wherein when the handle is in the dry suction position, the handle is pivoted towards the wet suction nozzle.

6. The wet/dry bare floor cleaner according to claim 5 wherein when the handle is in the wet suction position, the handle is pivoted towards the dry suction nozzle.

7. The wet/dry bare floor cleaner according to claim 6, wherein the base has opposite end portions, and the dry suction nozzle and the wet suction nozzle are respectively positioned at the opposite end portions of the base.

8. The wet/dry bare floor cleaner according to claim 4 wherein when the handle is in the wet suction position, it overlies one end of the base, and when it is in the dry suction position, it overlies another end of the base.

9. The wet/dry bare floor cleaner according to claim 4 wherein when the handle is in the wet suction position, the handle is pivoted towards the dry suction nozzle.

10. The wet/dry bare floor cleaner according to claim 4 wherein the diverter comprises a cylindrical barrel with an inlet at one side wall portion and an outlet at another side wall portion.

11. The wet/dry bare floor cleaner according to claim 10, wherein the diverter includes a conduit forming the outlet of the cylindrical barrel, and the handle is mounted to the conduit.

12. The wet/dry bare floor cleaner according to claim 11, wherein the conduit forms the connector between the handle and the diverter.

13. The wet/dry bare floor cleaner according to claim 10, wherein the cylindrical barrel is pivotally mounted in the base.

14. The wet/dry bare floor cleaner according to claim 4 and further comprising an agitator mounted to the base for vertical movement between a lowered position in contact with the surface to be cleaned and a raised position above the surface to be cleaned for selectively agitating the surface to be cleaned.

15. The wet/dry bare floor cleaner according to claim 14 and further comprising a connector between the agitator and the diverter for moving the agitator between the lowered and raised positions.

16. The wet/dry bare floor cleaner according to claim 15, wherein the agitator is a brush that is movably mounted to the base for scrubbing the surface to be cleaned.

17. The wet/dry bare floor cleaner according to claim 16 wherein the brush is mounted to the base for rotation about a vertical axis; and further comprising a motor for driving rotational movement of the brush with respect to the base.

18. The wet/dry bare floor cleaner according to claim 14, wherein the agitator is a brush comprising a first set of bristles and a second set of bristles wherein the first bristles are longer than the second bristles and are softer than the second bristles.

19. The wet/dry bare floor cleaner according to claim 18, wherein the first and second sets of bristles are in alternating juxtaposed rows in the brush.

20. The wet/dry bare floor cleaner according to claim 4 and further comprising a fluid delivery system including:

a fluid tank;

a fluid distributor for dispensing fluid onto a surface to be cleaned; and a fluid distribution conduit between the fluid tank and the fluid distributor.

* * * * *